US008875445B2

(12) United States Patent
Lippert

(10) Patent No.: US 8,875,445 B2
(45) Date of Patent: Nov. 4, 2014

(54) LIGHT WEIGHT MODULAR UNITS FOR STAGGERED STACKED BUILDING SYSTEM

(71) Applicant: Stephen Lee Lippert, San Jose, CA (US)

(72) Inventor: Stephen Lee Lippert, San Jose, CA (US)

( * ) Notice: Subject to any disclaimer, the term of this patent is extended or adjusted under 35 U.S.C. 154(b) by 38 days.

(21) Appl. No.: 13/507,963

(22) Filed: Oct. 29, 2012

(65) Prior Publication Data

US 2014/0115976 A1 May 1, 2014

(51) Int. Cl.
*E04B 1/348* (2006.01)

(52) U.S. Cl.
USPC ..... 52/79.2; 52/79.3; 52/79.7; 52/236.4

(58) Field of Classification Search
USPC ..... 52/79.2, 79.3, 79.7, 236.4, 79.1, 106, 52/236.3, 236.7
See application file for complete search history.

(56) References Cited

U.S. PATENT DOCUMENTS

| | | | | |
|---|---|---|---|---|
| 3,430,398 | A | 3/1969 | Green | |
| 3,455,075 | A * | 7/1969 | Frey | 52/79.7 |
| 3,503,170 | A | 3/1970 | Shelley | |
| 3,510,997 | A * | 5/1970 | Ratych | 52/79.2 |
| 3,520,098 | A * | 7/1970 | Johnston | 312/107 |
| 3,609,929 | A * | 10/1971 | Brown et al. | 52/79.7 |
| 3,642,339 | A * | 2/1972 | Ruderfer | 312/283 |
| 3,643,390 | A | 2/1972 | Shelley | |
| 3,678,637 | A * | 7/1972 | Klipfel | 52/79.3 |
| 3,716,954 | A | 2/1973 | Kelbish | |
| 3,724,141 | A * | 4/1973 | Kelleher | 52/79.11 |
| 3,772,834 | A | 11/1973 | Barraud | |
| 3,835,601 | A | 9/1974 | Kelbish | |
| 4,118,905 | A | 10/1978 | Shelley | |
| 4,184,296 | A * | 1/1980 | Vitalini | 52/79.4 |
| 4,263,757 | A * | 4/1981 | Thys | 52/79.1 |
| 4,277,924 | A * | 7/1981 | Chimentin | 52/136 |
| 4,586,299 | A * | 5/1986 | Bayer | 52/79.7 |
| 6,035,583 | A * | 3/2000 | Papke | 52/79.1 |
| 6,625,937 | B1 * | 9/2003 | Parker et al. | 52/79.7 |
| 6,826,879 | B1 * | 12/2004 | Allen et al. | 52/236.3 |
| 8,429,857 | B2 * | 4/2013 | Melrose et al. | 52/79.1 |

* cited by examiner

*Primary Examiner* — William Gilbert
*Assistant Examiner* — Alp Akbasli
(74) *Attorney, Agent, or Firm* — GSS Law Group

(57) ABSTRACT

Manufactured modular units for the creation of multistory buildings are staggered stacked so as to create "bonus spaces" between units. Several lighter weight structural versions are presented. The first is a wood frame or cold rolled shape light gauge metal framed modular unit. The second version uses cross laminated timber panels to create the modular unit. The third version uses hot rolled steel shapes for the structure of the modular unit to be staggered stacked. These lighter weight modular units have many advantages. They are more easily transported at a lower fuel costs. They can be craned to higher levels with a single crane. Seismic forces are decreased. Less modular unit weight also allows for greater unit area. Thus, fewer units need to be transported and fewer units need to be craned. Also, a larger unit area and larger "bonus" area allows for more flexible space planning.

11 Claims, 14 Drawing Sheets

SEE FIG 5A,5B FOR ATTACHED CONDITION

SEE FIG 4A FOR ATTACHED CONDITION

SEE 5D FOR
ATTACHED CONDITION

SEE FIG 4C FOR
ATTACHED CONDITION

SEE FIG 6A FOR ATTACHED CONDITION

SEE FIG 8A FOR ATTACHED CONDITION

SEE FIG 9A FOR ATTACHED CONDITION

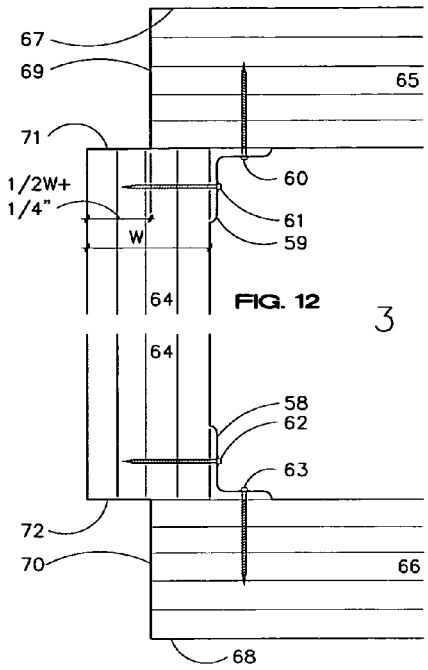
FIG. 12
FIG. 13
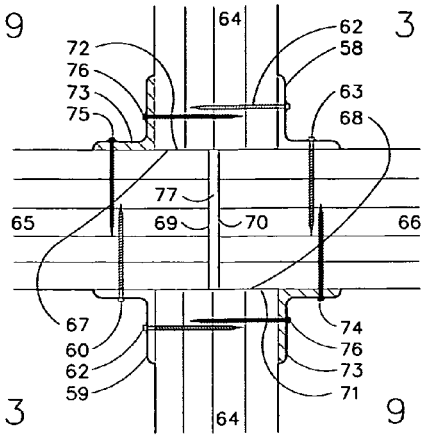
FIGURE 14
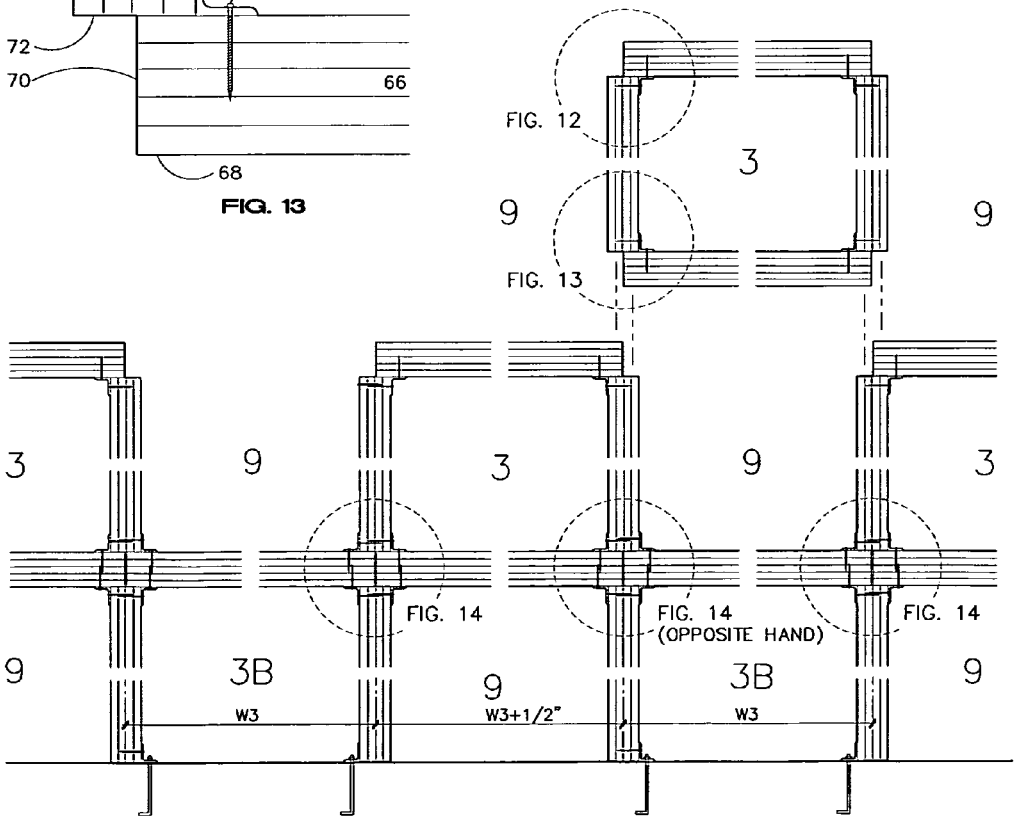
FIGURE 11

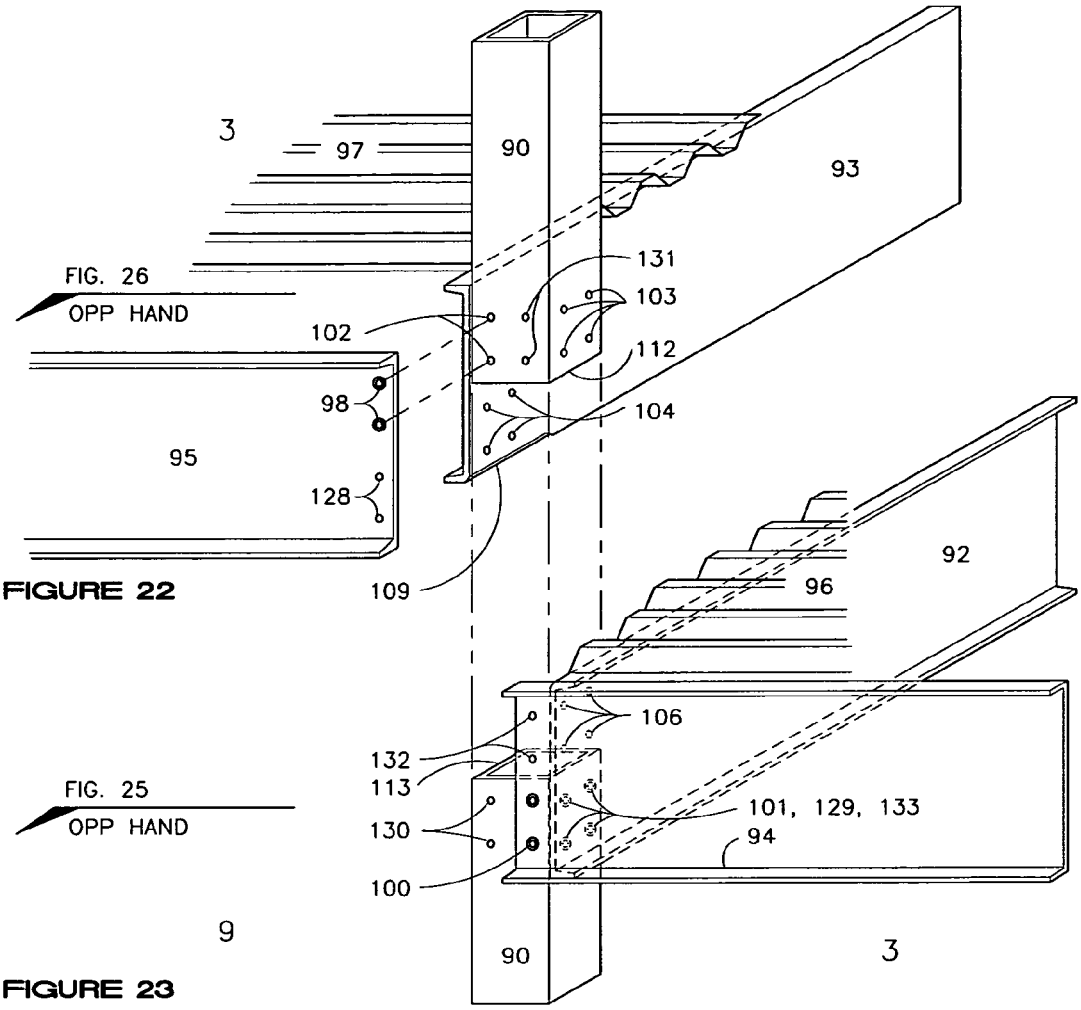
FIGURE 22
FIGURE 23
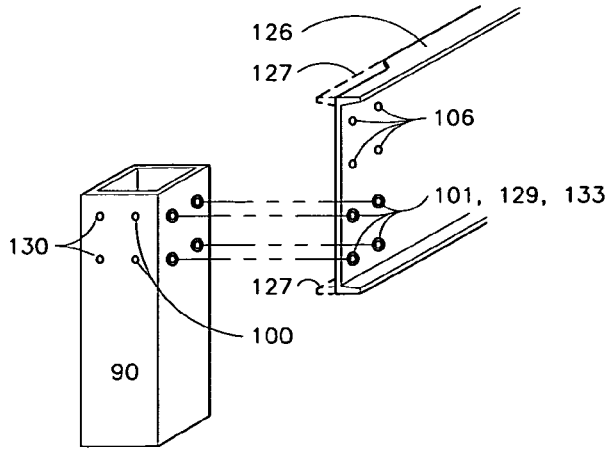
FIGURE 24

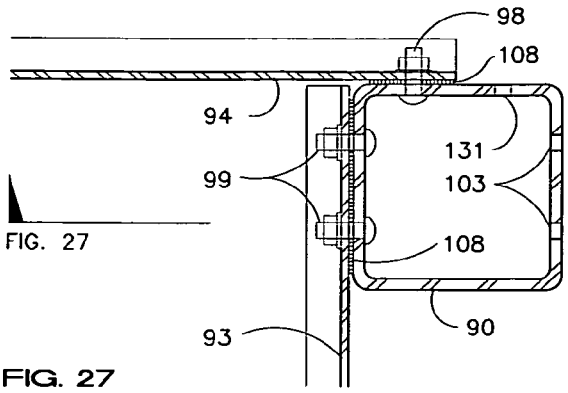
FIG. 27
FIG. 27
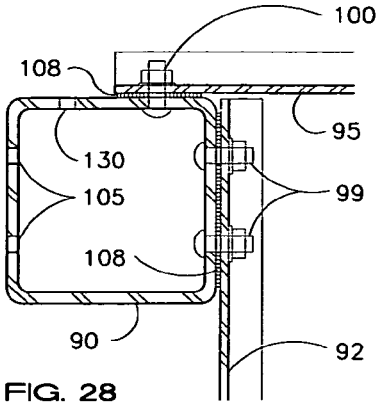
FIG. 28
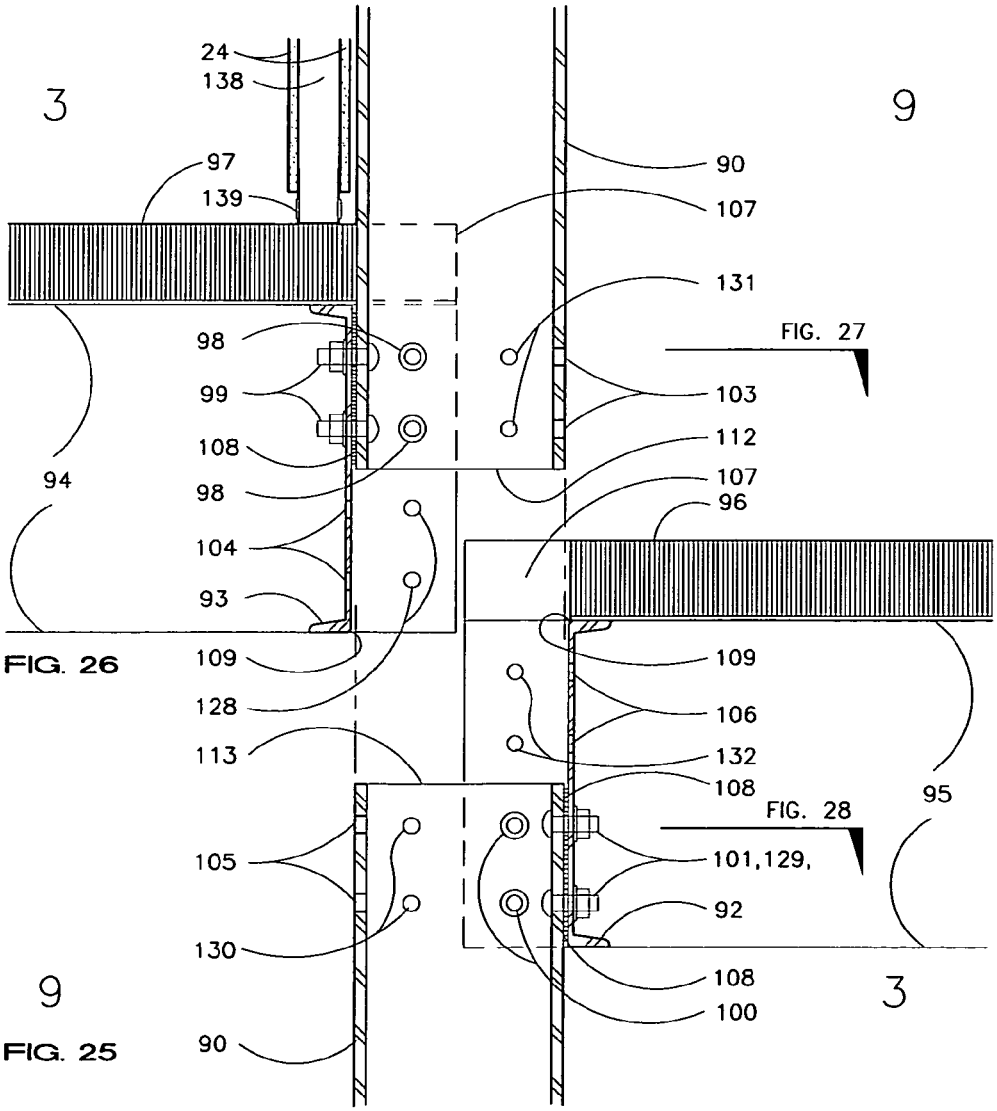
FIG. 26
FIG. 25

LIGHT WEIGHT MODULAR UNITS FOR STAGGERED STACKED BUILDING SYSTEM

FIELD OF INVENTION

The construction of a multi-level building by assembling prefabricated modular units in a staggered manner that produces a "bonus space" between units.

BACKGROUND

Prior Art

Moshe Safdie's assemblage of prefab concrete boxes for the Habitat housing exhibit at "Montreal Expo 67" World's Fair caused a great deal of interest in new ways of stacking prefab modular units. The late 1960's and early 1970's produced a spate of patents for "staggered stacking" of monolithic concrete boxes for multi-level buildings. These are Shelley (U.S. Pat. Nos. 3,503,170 / 3,643,390/ 4,118,905), Kelbish (U.S. Pat. Nos. 3,716,954 and 3,835,601) and Barraud (U.S. Pat. No. 3,772,834). Shelley uses post-tensioning to connect the concrete boxes. Kelbish uses pin connections between upper and lower units. Barraud welds steel plates attached to upper and lower unit columns. In an alternate, Barraud shows a concrete box supported by wide flange steel columns that is welded to steel rebar that is embedded in the walls of the concrete box.

The disadvantages of these concrete boxes are many. Their great weight limits the size of the structure that can be transported on highways and city streets. The dead load for a typical 6 inch thick floor, roof and side walls for a small 11'×25' module is over 65,000 lbs. Barraud mentions that a large concrete module 70 feet long can weigh 120,000 lbs. This is a huge problem. Normal highway trailer weight is typically limited to 46,000 lbs. Higher loads would require specialized trailers with many axles and can require one or two escort cars to accompany the trailer. This is costly. A heavy module weight would also exclude all but the most extreme heavy duty cranes. The height that the unit could be lifted by a crane would also be limited. When Safdie's concrete modules were lifted for the creation of Habitat 67, two cranes, each with separate operators, were used to lift the heavy (though still small) units to the required heights. This was/is dangerous and should be discouraged.

The weight of these concrete modular units also carries a seismic penalty; more weight produces more lateral loads that need to be resisted. Seismic code requirements have dramatically increased since the early 70's. The connections between modular units have to overcome these increased loads.

An extremely small sized concrete module, due to weight avoidance, also limits design flexibility for space planning for multi-family housing. A 12' wide box module with a net interior width of 11' would provide a cramped living room.

Despite the initial interest in staggered stacking of modular housing units in the late 1960's and early 1970's, the problems were so profound, that this author does not know of any building that has been actually constructed by a stagger stack assemblage.

The need exists for relatively light weight and more flexible structures. Light weight structures that can take advantage of the largest allowable highway unit volume but weigh less than the nominal allowable highway load of 46,000 lbs. for standard trailers. Most states allow the transport of 14 foot wide by 70 foot long units. Some allow 16 foot and even 18 foot wide structures.

Wood framed or light gage cold rolled steel framed modular units could create such light weight, but larger building area, modular units. Larger area modular units would also reduce the number of transport trips and the number of crane lifts. Larger area modular units also increase the possibilities for space planning.

Also, lighter weight and more flexible wood and cold rolled framed structures could more cost effectively resist seismic loads.

Cross Laminated Timber (CLT) panels, a product developed in Europe, have recently been making inroads in North America, especially Canada. Larger volume modular units for staggered stacking could be created from CLT panels, since they are ⅓ the weight of concrete panels.

Hot rolled steel structures are another option for light weight modular units. A light weight hot rolled shape steel frame structure is shown by Green (U.S. Pat. No. 3,430,398). The long side of the structure is composed of tube columns forming a multitude of bays with each bay having a roof tube beam and a floor inverted angle. The contact area of the floor's inverted angle beam with the tube column is minimal. Not much unit rigidity can be produced from the column and floor inverted angle connection. Segmented beams between columns will produce excessive deflection of the long side of the unit, especially during crane lifting. Some tube columns with smaller tube inserts slightly telescope into aligned hollow tube columns of lower units. Not shown or noted is any welding or bolting in support of the column splice or the upper unit overlapping inverted L angle over the lower unit tube beam. A seismic event would send the modular units flying.

Green's structural floor beam, an inverted angle, is an inefficient shape for the support of floor joists and decking. Its span cannot be very long. The contact area of the inverted angle with the column is minimal. No great connection strength can be created.

A secure connection between the long side floor beam and the column is needed. Likewise, a secure connection between units is needed. Welding around the tube column splice is possible, but no strong connection strength could be created at the column/inverted angle beam joints with Green's design.

Another disadvantage is that when the unit is craned into place, the inverted angle of an upper unit's floor overlaps the lower unit's roof beam. The result is that the floor height of an adjacent unit is slightly higher (by the flange thickness of floor inverted angle leg). Extra concrete topping over the lower unit's ceiling deck will be needed to account for the difference. Unnecessary weight is added to the building and to seismic forces that will need to be resisted.

The need exists for a stronger steel frame module with stronger module to module connections. Also, the floor structure should be aligned with adjacent modules. Likewise, it would be beneficial to have field connections that can be mostly bolted for easier and quicker site assembly and eventual disassembly at the end of the building's useful life.

SUMMARY

The present invention is distinguishable and an improvement over prior art by providing for light-weight, flexible, but structurally strong, modular units using wood frame, cold rolled steel frame, and CLT panels. This invention develops:

1. Unit long wall roof/wall corner shapes and floor/wall corner shapes that allow adjacent unit floor levels to align.

2. Structural reinforcement of the unit's long roof/wall and floor/wall corner shapes to create a box shape that can withstand the stresses due to crane lifting.
3. Field unit connections that can be primarily nailed, screwed or use "Simpson" type sheet metal connectors and/or straps.
4. Optional factory finished exterior wall siding. Just field installed sealant is needed at the joint between units to complete the exterior envelope waterproofing.
5. A ground floor unit without an attached floor. Instead, a unit with only a roof and walls attaches directly to a concrete slab. This "floorless" unit may have interior transverse walls that brace the unit's long walls. Cabinetry, counters, toilets, lavatories, etc. are wall hung.

The present hot rolled steel structure, for staggered stacked modular units, are distinguishable and an improvement over prior art by developing:

1. Long wall floor and roof corner shapes that allows for adjacent unit floors to align.
2. Unit to unit field connections, preferably using bolts, to create stronger moment strength. These connections need to be more structurally robust for the construction of taller buildings with more significant dead and seismic loads.
3. Because the modular units will preferably be delivered with interior finishes and cabinetry, it would be advantageous of avoid the fire hazard of field welding unit to unit connections. Welding also requires more expensive labor and requires extra 3$^{rd}$ party inspections that would increase the building cost.
4. A ground floor unit without an attached floor. Instead, a unit with only a roof, columns and walls may attach directly to a concrete slab. Cabinetry, counters, toilets, lavatories, etc. are wall hung.
5. Optional long beams with deep shapes, including castellated, for long spans.
6. Optional use of very large steel tube columns with infill concrete and rebar to support tall buildings.

Other advantages and aspects to providing lighter, more flexible, and stronger modular units for staggered stacking will become apparent from a review of the attached drawings and their description.

DRAWING NOTES

Figure 1:
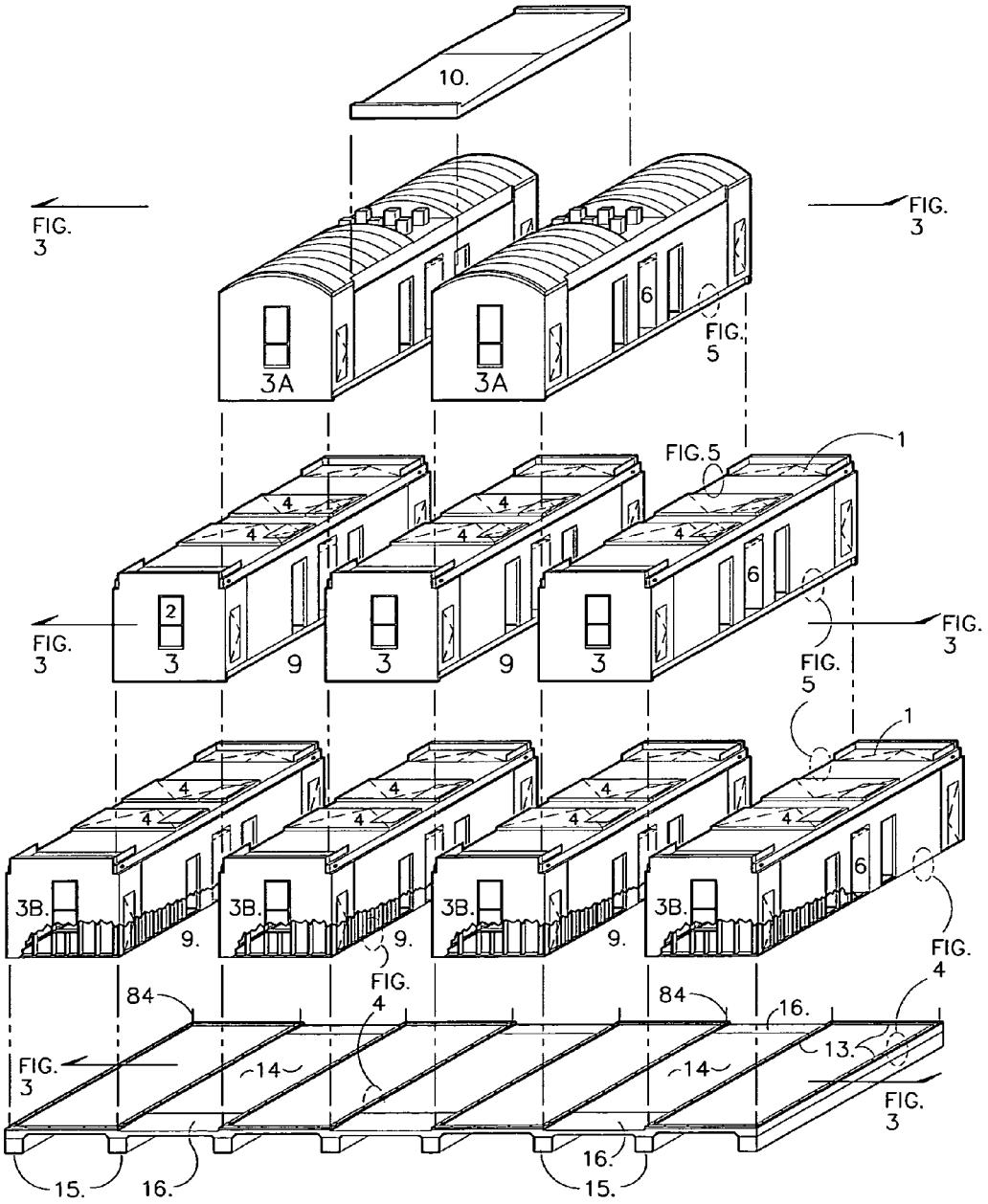
FIG. 1 Isometric view of separated modular units

1. Sloped deck.
2. Window.
3. Wood or cold rolled metal frame manufactured modular units.
3A. Top level manufactured modular unit.
3B. First level manufactured modular unit over a concrete slab.
4. Wood or cold rolled metal framed wall panel on unit (3, 3B) roof for field tilt-up installation.
5. Exterior wood frame or cold rolled metal frame side wall panel.

6. Modular unit interior wall.
7. Angle metal connector.
8. Field installed folding doors and frame or sliding glass door.
9. Void space between staggered stacked modular units (3A, 3, 3B).
10. Sloped wood or cold rolled metal framed roof panel.
11. Roof panel (10) joist. (Insulation not shown for clarity.)
12. Anchor bolt.
12A. Threaded rod.
12B. Threaded rod coupling.
13. Field installed pressure treated 3×6 (preferable) sill plate with counter sunk anchor bolt nut and washer.
14. Top of concrete slab over grade or podium.
15. Concrete footing.
16. Sloped concrete deck.
17. Roof membrane.
18. OSB/plywood shear sheathing
19. Modular unit wood or cold rolled metal wall stud(s), preferably 2×6, at 16-24 inches on center.
20. ½ inch gap preferred, optional ¼-¾ inch gap.
21. Modular unit (3A, 3, 3B) wood or cold rolled metal roof joist at 16-24 inches on center. (Insulation not shown for clarity.)
22. Modular unit (3A, 3) wood or cold rolled metal floor joist at 16-24 inches on center. (Acoustical insulation not shown for clarity.)
23. Optional OSB/plywood sheathing extension of about 2 inches below unit wall sill plate (52) for connection to sill plate (13).
24. Gypsum board sheathing typical, prefer exterior rated glass mat shin.
25. Field installed gypsum board sheathing.
26. Field installed shear edge fastener through shear sheathing extension (23) into sill plate (13).
27. Field installed fastener.
28. Field installed finish wall base.
29. Temporary blocking to protect modular unit (3B) extended shear sheathing (23).
30. Temporary blocking to protect gypsum board under modular unit (3A, 3).
31. Optional factory applied glue.
32. Optional field applied glue.
33. Unit (3, 3A, 3B) longitudinal roof rim joist/beam.
33S. Exposed side of roof rim joist/beam (33).
34. Unit (3, 3A) longitudinal floor rim joist/beam.
34B. Bottom of floor rim joist/beam (34).
34S. Exposed side of roof joist/beam (34).
35. Field installed fastener connecting unit (3, 3A, 3B) wall top plate (38) to upper unit (3, 3A) floor rim joist/beam (36) or roof panel rim joist/beam (55).
35A. Optional factory partially installed fastener for later field installation (36).
36. Field installed fastener connecting unit wall floor sill plate (37) to lower unit longitudinal roof rim joist/beam (33).
36A Optional factory partially installed fastener for later field installation (36)
37. Unit (3, 3A) wall sill plate, typically 2×6.
38. Unit 3, 3B) wall top plate, typically 2×6.
38T Top of top plate (38).
39. Area of deletion of factory installed gypsum board (24) for accessibility to field install fasteners (35, 36).
40. After field fastener installation (35, 36), provide gypsum board at area left open for accessibility.
41. Optional sheet metal plate connector with approximate bent 10-15 leg.
42. Factory installed fastener into sheet metal connector (41).
43. Wood or steel pilaster column, typically 4×6, spaced 4'-8' on center.
43T Top of wood or steel pilaster column (43).
43B Bottom of wood or steel pilaster column (43).
44. Column base connector for pilaster column (43).
45. Factory installed fastener through unit (3, 3A) sill plate (37) into floor rim joist/beam (34).
46. Factory installed fastener through unit (3, 3A, 3B) wall top plate (38) unit roof (3, 3A, 3B) roof rim joist/beam (33).
47. Shim.
48. Unit (3, 3A) floor sheathing.
49. Unit (3, 3B) roof sheathing.
50. Optional field installation of metal strap with fasteners into joists (21) and (22).
51. Kurf cut bottom of wall sill plate (37) for optional field installation of metal strap (50). Align kurf cut with floor joists (21, 22).
52. Unit 3B wall sill plate.
53. Factory installed fastener through pilaster column (43) into wall sill plate (37).
54. Factory installed fastener through pilaster column (43) into wall top plate (38).
55. Column cap metal connector.
56. Column base metal connector.
57. Angle metal connector.
58. Factory installed metal angle connector at unit longitudinal wall/floor intersection.
59. Factory installed metal angle connector at unit longitudinal wall/roof intersection.
60. Factory installed fastener through wall/roof metal angle connector (59) into roof.
61. Factory installed fastener through wall/roof metal angle connector (59) into wall.
62. Factory installed fastener through wall/floor metal angle connector (58) into wall.
63. Factory installed fastener through wall/floor metal angle connector (58) into floor.
64. Cross Laminated Timber (CLT) unit (3, 3A, 3B) wall. Finish materials not shown for clarity.
65. Cross Laminated Timber (CLT) unit (3, 3A, 3B) roof. Finish materials not shown for clarity.
66. Cross laminate timber (CLT) unit (3, 3A) floor. Finish materials not shown for clarity.
67. Top of CLT unit (3, 3B) roof (65) at recessed edge.
68. Bottom of CLT unit (3, 3A) floor (66) at edge.
69. Face of CLT unit (3, 3A, 3B) recessed roof (65) edge.
70. Face of CLT unit (3, 3A) recessed floor (66) edge.
71. Exposed top of CLT unit (3, 3A, 3B) wall (64).
72. Exposed bottom of CLT unit (3, 3A) wall (64).
73. Field installed metal angle connector.
74. Field installed fastener through metal angle connector (73) into unit (3, 3A) CLT floor (66).
75. Field installed fastener through metal angle connector (73) into unit (3, 3A, 3B) CLT roof (65).
76. Field installed fastener through metal angle connector (73) into unit (3, 3A, 3B) wall (64).
77. Approximate ¼ inch gap, align with center of wall.
78. Beveled edge of unit (3, 3A, 3B) roof (65).
79. Unit (3, 3B) top of wall (64).
80. Unit (3, 3A) bottom of wall (64).
81. Beveled edge of unit (3, 3A) floor (66).
82. Lower unit (3, 3B).
83. Upper unit (3, 3A).
84. Threaded rod close to ends of walls for connection to other threated rods for attachment to upper unit wall or roof.
85. Field installed diagonal fastener.
86. Gusset plate.

87. 18 ga sheet metal backing
88. Plate with hole for threaded rod and spring tightened nut.
89. Not used.
90. Steel tube column at exterior transverse wall, H column optional.
91. Steel tube column at unit interior long side, H column optional.
92. Unit (3, 3A, 3B) steel channel long roof beam.
93. Unit (3, 3A) steel channel long floor beam.
94. Unit (3, 3A, 3B) transverse steel channel roof beam.
95. Unit (3, 3A) transverse steel channel floor beam.
96. Unit (3, 3A, 3B) roof metal deck.
97. Unit (3, 3A) floor metal deck.
98. Factory installed bolts through unit (3, 3A) floor level transverse beam (95) holes and base of column (90) holes (102).
99. Factory installed bolts through unit (3, 3A) floor level long beam (93) and base of column (90).
100. Factory install bolts through unit (3, 3A, 3B) roof level transverse beam (95) holes and top of column (90) holes.
101. Factory installed bolts through unit (3, 3A, 3B) roof level long beam (92) holes (129) and top of column (90) bolt holes (133).
102. Unit column (90) bolt holes at floor level, exterior face, for factory installed bolts (98).
103. Unit column (90) holes at floor level for field installed bolts.
104. Prefabricated holes in floor level long beam for field connection to lower unit (3, 3B) top of column (90) holes (105).
105. Prefabricated holes at top of column (90) for field connection to upper unit (3, 3A) floor level channel (93) prefab holes (104).
106. Prefabricated holes in unit roof level long channel (92) for field connection to upper unit bottom of column prefab holes (103).
107. Notch metal deck around column (90).
108. Factory installed shim, approximately ⅛ inch.
109. Optional approximate ¼ inch bevel cut at column (90) area only.
110. Field installed blind expansion bolts through upper unit column (90) prefab holes (103) and lower unit long channel roof beam (92) prefab holes (106).
111. Field installed blind expansion bolts through lower unit column (90) prefab holes (105) and upper unit long channel floor beam (93) prefab holes (104).
112. Bottom of unit column (90), aligned with mid-point of floor channel beam (93).
113. Top of unit column (90), aligned with mid-point of roof channel beam (92).
114. Field installed shim.
115. Optional concrete and optional rebar.
116. Optional field installed light weight concrete over acoustical mat.
117. Optional rigid foam on upper unit (3, 3A).
118. Optional lamina.
119. Optional field installed sealant and backer rod.
120. Waterproofing.
121. Approximate ¾ inch gap.
122. Approximate ½ inch gap.
123. Align face of lamina with upper unit (3, 3A) sidewall.
124. Optional rigid foam on lower unit (3, 3B).
125. Alternate fastener connector.
126. Optional I beam.
127. Cut flange to face of web at column location.
128. Transverse floor beam web bolt holes for field connection.
129. Bottom of long beam web bolt hole.
130. Top of unit column (90) exterior face bolt hole for field connection.
131. Bottom of unit column (90) exterior face bolt holes for field connection.
132. Unit roof transverse beam (95) bolt holes for field connection.
133. Top of unit column (90) bolt hole for factory connection.
134. Field installed expansion bolt for steel tubes.
135. Diagonal brace and optional gusset plate, can occur in transverse and/or long direction.
136. Rebar or mesh reinforcement at unit steel deck splice.
137. Concrete deck topping
138. Metal light gage metal studs, typically 16-24 inches on center.
139. Light gage metal extended leg sill channel with 1½ inch perforations.
140. Optional preattached "hold down" metal connector attached to an upper unit exterior wall floor joists.
141. Optional preattached "hold down" metal connector attached to a lower unit exterior wall roof joists.
142. Optional field installed threaded bolt.

DETAILED DESCRIPTION OF DRAWINGS

FIG. 1. Isometric view of several levels of vertically separated and horizontally spaced modular units (3A, 3, 3B) over a concrete slab (14). The concrete slab (14) may be on grade or the podium level over a garage or commercial space. The lowest level units (3B) lack an attached floor. The unit walls attach directly to optional pressure treated wood sill plates (13) attached the concrete slab (14). When modular units are delivered with factory installed siding, the resistance to end of wall uplift is through the use of threaded rods close of building corners. These are attached to field installed threaded rods (84) into the concrete slab (14). These rods (84) are for attachment with other threated rods that extend to the top level unit's (3A) wall or roof.

If siding is field installed, then exterior straps and concrete embedded straps that attach to face of exterior wood sheathing can be used to resist uplift. Top level units (3A) can have different shaped roofs such as barrel, rake, or flat. Wall panels (4) for interior or exterior walls at upper level void space (9) can be transported on the roof of any level unit (3B, 3). The long wall/floor and wall/roof corners are targeted for enlargement.

Figure 2A:
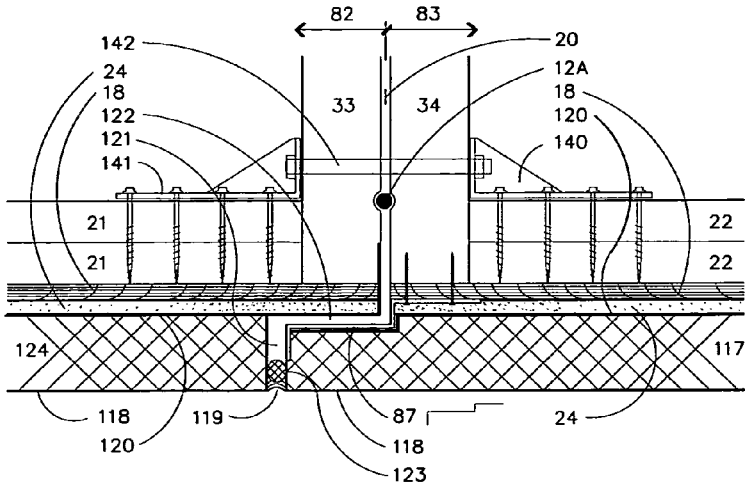
FIG. 2A Plan view of exterior joint between units
Figure 2:
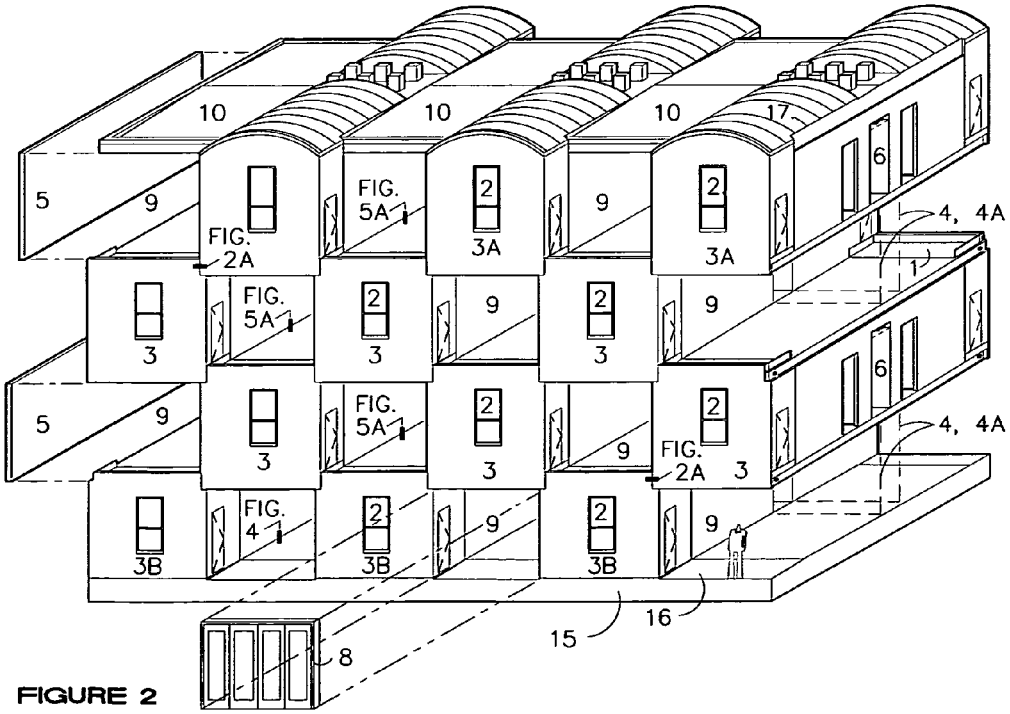
FIG. 2 Isometric view of attached modular units

FIG. 2. Isometric view of attached modular units from FIG. 1. The void space (9) created are enclosed with folding doors (8) or optional wall panels. At building ends with exposed void space (9), end wall panels (5) enclose space and structurally support upper units. At the building top level, void space (9) is enclosed with roof panels (10).

FIG. 2A. Plan view of two units exterior wall intersection at the unit's floor/roof framing. It shows an option for a unit's exterior walls to have factory installed EIFS (exterior insulation finish system) veneer (118, 124, 120). With the unit's siding preinstalled, only sealant and backer rod (119) is needed to make the unit's exterior wall joint intersection watertight. In this way, no scaffolding is needed to provide a weather resistive barrier and exterior siding for the building. In order to allow the upper unit (83) EIFS panel (117) to overlap the lower unit's (82) exterior substrate (24), the upper unit (83) EIFS panel (117) is notched (118A). The notch allows a shim gap (122) between the upper (83) and lower (82) units. 18 ga, or better, sheet metal backing (87) structurally reinforces the rear of the EIFS rigid foam (117) at the notched joint.

Structurally, upper and lower unit exterior walls may have an optional lateral drag line or "hold down" connection. (140)(141)(142). Likewise, units at all levels may be vertically connected with a threaded rod (12A). The section of the threaded rod (12A) is shown in FIGS. 4C and 5D.

Metal panels, cement panels, and curtain wall panels are also options for unit (3) factory installed exterior siding.

Figure 3:
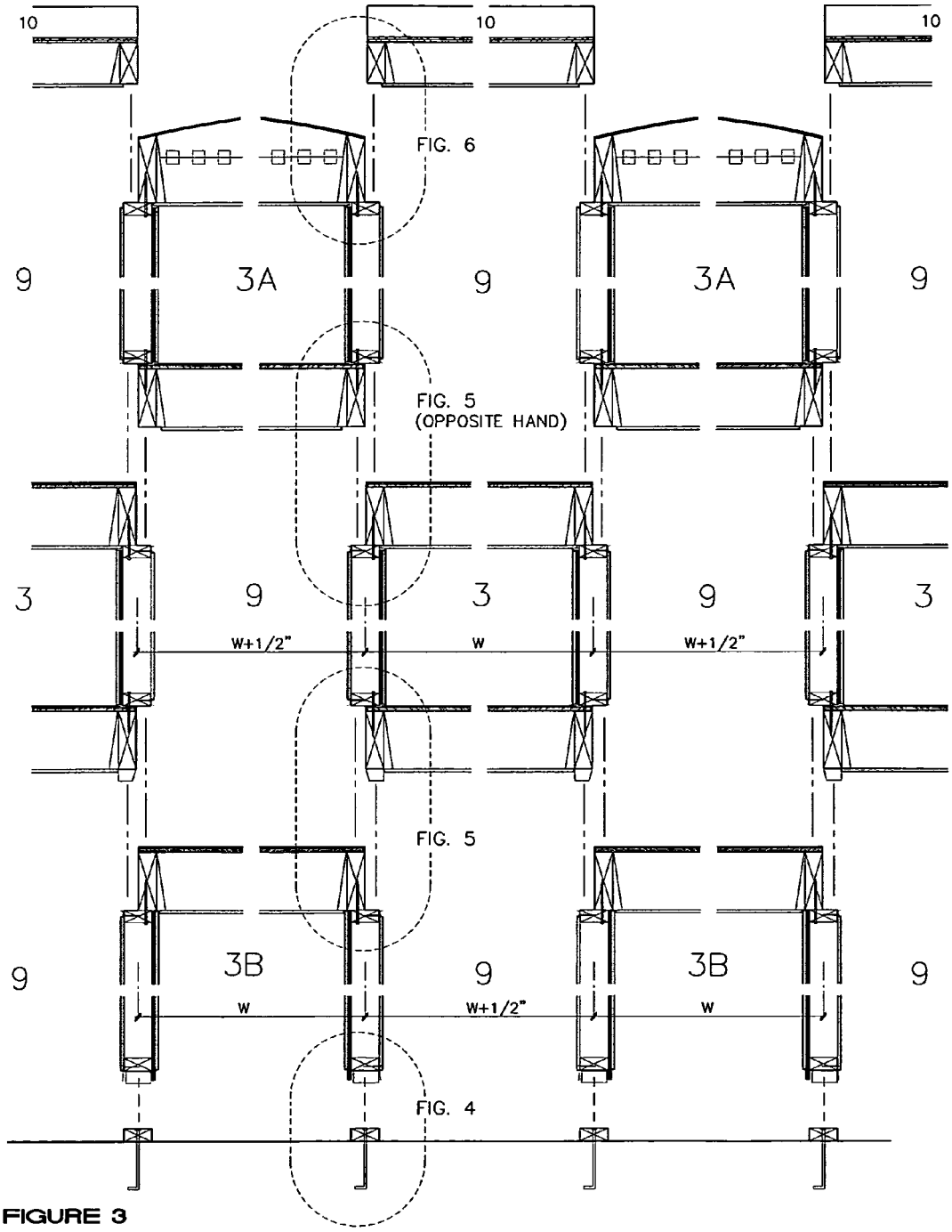
FIG. 3 Section view of separated modular units

FIG. 3. Section view of vertically separated modular units (3A, 3, 3B). The lowest level of units are horizontally spaced (9) by a distance of W+approximately ½", where W=width of the modular unit (3B) as measured from the centerline of the stud framing of a long wall to the centerline of stud framing of the opposite long wall. The next upper level unit (3) is centered over the void space (9) below. Likewise each level's upper level unit (3) or (3A) is located and centered over the void space (9) below. At the top level, a roof panel (10) is centered over the void space (9). Unit connection details are targeted for enlargement.

As an option, the lowest level may be garages. Also, lowest units with integral floors (3) may be supported by spread footings.

Figure 4:
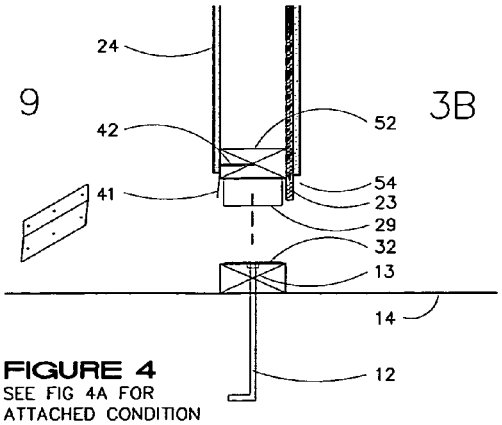
FIG. 4 Enlarged section of lowest level separated unit wall
Figure 4A:
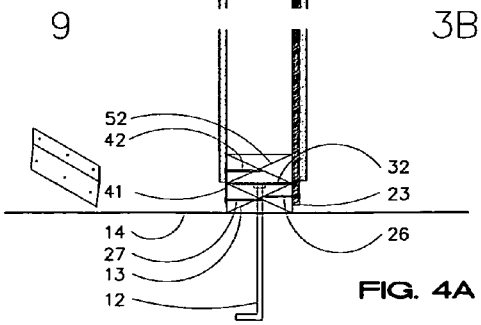
FIG. 4A Enlarged section of lowest level attached unit wall to concrete slab FIG. 5 Enlarged section of separated lower unit long wall/roof corner and upper unit long wall/floor corner FIG. 5A Attached condition of lower unit long wall/roof corner and upper unit long wall/floor corner FIG. 5B Alternate attached condition of lower unit long wall/roof corner and upper unit long wall/floor corner FIG. 4B Alternate enlarged section of lowest level separated unit wall FIG. 4C Alternate enlarged section of lowest level attached unit wall to concrete slab FIG. 5C Alternate enlarged section of separated lower unit long wall/roof corner and upper unit long wall/floor corner FIG. 5D Alternate enlarged section of attached condition of lower unit long wall/roof corner and upper unit long wall/floor corner FIG. 5E Alternate plan section of strap connector of upper unit floor to lower unit roof FIG. 6 Enlarged sections of separated roof panel and top level modular unit FIG. 6A Enlarged section of attached roof panel and top level modular unit FIG. 7 Section of separated alternate modular units FIG. 8 Enlarged section of lowest level separated alternate unit wall FIG. 8A Enlarged section of lowest level attached alternate unit wall to concrete slab FIG. 9 Enlarged section of separated lower unit long wall/roof corner and upper unit long wall/floor corner FIG. 9A Enlarged section of attached lower unit long wall/roof corner and upper unit long wall/floor corner FIG. 10 Alternate section of attached lower unit long wall/roof corner and upper unit long wall/floor corner FIG. 11 Alternate section of attached and separated Cross Laminated Timber (CLT) units FIG. 12 Enlarged section of wall/roof corner of CLT unit FIG. 13 Enlarged section of wall/floor corner of CLT unit FIG. 14 Enlarged section of attached lower unit long wall/roof corner and upper unit long wall/floor corner FIG. 15 Alternate section of attached and separated CLT units FIG. 16 Enlarged section of alternate wall/roof corner of CLT unit FIG. 17 Enlarged section of alternate wall/floor corner of CLT unit FIG. 18 Enlarged section of alternate attached lower unit long wall/roof corner and upper unit wall/floor corner FIG. 19 Isometric view of steel framed modular unit FIG. 20 Isometric view of lowest level steel framed modular unit FIG. 21 Isometric view of multilevel assemblage of staggered stacked steel framed modular units FIG. 22 Isometric view of a steel framed upper unit column to floor long beam and exterior wall transverse beam FIG. 23 Isometric view of a steel framed lower unit column to roof long beam and exterior wall transverse beam FIG. 24 Isometric view of an alternate long beam or transverse beam FIG. 25 Section of steel column/roof long and transverse beams FIG. 26 Section of steel column/floor long and transverse beams FIG. 27 Plan of steel column/floor long and transverse beams FIG. 28 Plan of steel column/roof long and transverse beams FIG. 29 Section of attached lower unit column/roof beam (s) and upper unit column/floor beam(s)

FIGS. 4 and 4A. Enlarged section of the lowest unit's (3B) bottom wall in separated and attached conditions. Unlike upper modular units (3,3A), the lowest modular units (3B) lack a preattached floor. The concrete slab (14) becomes the floor for the unit. Thus, the unit's walls are directly attached to the slab. The walls are typically one or two layers of gypsum board (24) are over wood shear sheathing (18) over 2-3 engineered wood studs (19) spaced 16-24 inches on center. The wood shear sheathing (18) may extend (23) about 2 inches beyond the wall sill plate (52) for later attachment in the field to a preinstalled pressure treated wood sill (13). As an option, a preattached metal connector angled sheet metal (41) is fastened (42) to the wall's sill plate (52). The combination of shear sheathing (18) edge nailing (26), plus the field fastening (27) of the spaced connector plate (41) to the field sill plate (13), and optional glue (32) applied to the field sill plate (13), attaches the unit (3B) to the slab. Temporary blocking (29) may be installed to protect the extended shear sheathing (23) and optional connector plate (41) when the unit is transported or crane lifted.

Besides the exterior walls of lowest level units (3B), the interior transverse walls brace the unit's long walls. Because these units lack a floor; cabinets, counters, toilet, lavatories are wall hung.

Figure 5:
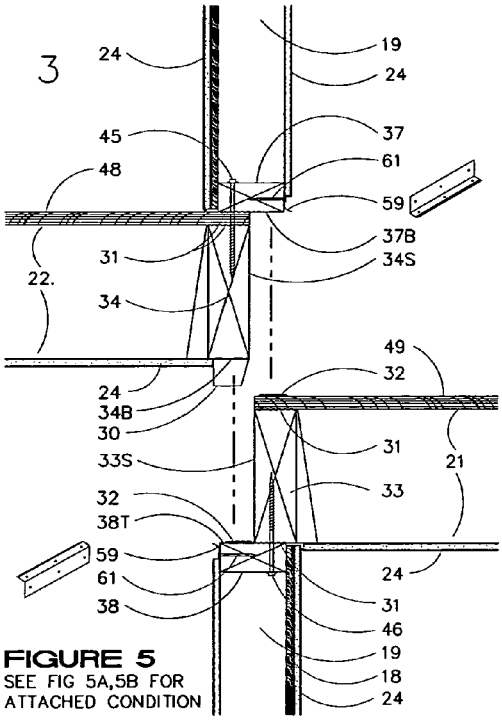
Figure 5B:
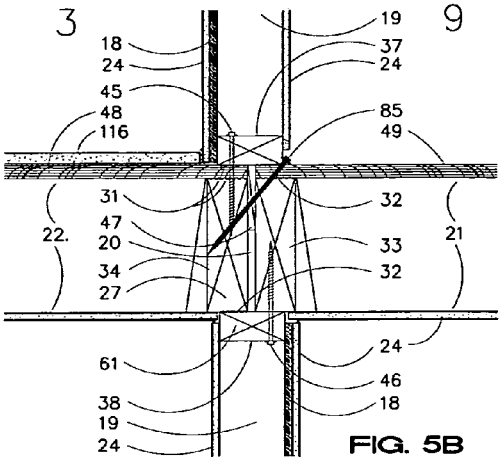
Figure 5A:
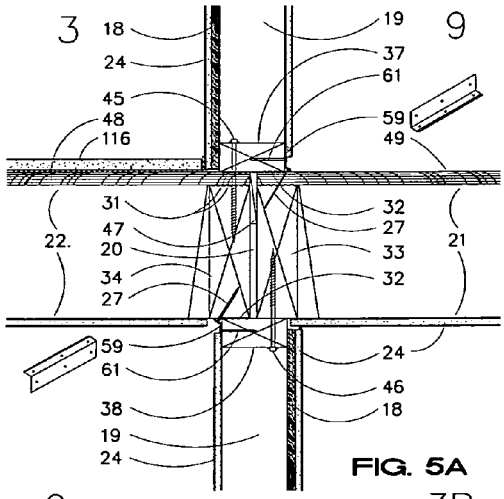

FIGS. 5 and 5A. Shows enlarged sections of separated and attached conditions of lower unit long wall/roof corner and upper unit long wall/floor corner. The roof of the lower unit is composed of shear sheathing (49) over engineered joists (21) typically 16-24 inches on center. Along the long wall, the roof joists (21) are typically supported by a engineered rim joist/beam (33). This rim joist/beam can span corridor widths and other openings. The roof joists (21) and rim joist/beam (33) may be glued (31) to the wood roof sheathing (49). The supporting wall is typically one or two layers of gypsum board (24) over wood shear sheathing (18) over 2-3 engineered wood studs (19) spaced 16-24 inches on center. The outside face (33S) of the roof rim joist/beam (33) is recessed back from the outside face of the wall stud (19) by a distance of ½ the width of the stud plus approximately ¼ inch. The wall's engineered top plate (38) is fastened (46) about 8 inches on center to a continuous roof rim joist/beam (33) and may be optionally glued (31) together. A sheet metal angled connector plate (59) is preattached (61) to the lower unit wall top plate (38).

The upper unit wall and floor construction is like the lower unit's wall and roof construction. The floor is composed of shear sheathing (48) over engineered joists (22) typically 16-24 inches on center which are supported by a continuous rim joist/beam (34). The floor's long edges support an offset wall. The outside face of the floor rim joist/beam (34S) is recessed from the outside face of the upper wall studs by a distance of ½ the width of wall stud (19) plus about ¼ inch. The upper unit wall is typically composed of 1 or two layers of gypsum board (24) over wood shear sheathing (18) over engineered studs (19). An engineered sill plate (37) is fastened (45), about 6-8 inches on center, to the floor rim joist/beam (34). An optional sheet metal angled connector plate (59) is preattached (61) to the upper unit wall top plate (37).

Before the upper unit (3,3A) is positioned over the lower unit (3,3B), optional glue (32) at lower roof sheathing edge and top wall plate (38T) may be applied. Optional temporary blocking (30) at the underside outside edge (34B) of the long wall floor rim joist/beam (34) may be removed. Once the upper unit is positioned, the units are connected with field fasteners (27) through sheet metal connectors (59) attached to the upper unit wall stud sill plate (37) and through sheet metal connectors (59) attached to the lower unit wall stud top plate (38). Between the face of each unit's rim joist/beams (33S) and (34S) should be a shim (20) distance of about ½ inch.

The long wall wood shear sheathing may be placed on the either side of the wall. For this design and all other alternates, the shear sheathing may alternate from floor to floor so that the sheathing is aligned and connected to the same long wall rim joist/beam.

For this design and all other alternates, a light-weight gypsum or concrete topping (116) may be poured over an optional acoustical mat over the floor sheathing (48)(49).

FIG. 5B. Is an alternate modular unit attachment method from that shown in FIG. 5A. The sheet metal connecter angles (59) are deleted and a field installed diagonal fastener (85) at approximately 6-8 inches on center is used to connect lower unit roof (49)(33) and upper unit floor rim joist/beam (34). The diagonal fastener (85) may be used on one or both sides of the upper unit long wall. It also can be used on one or both sides of the lower unit wall into the rim joist/beams (33)(34) of both units.

Figure 4B:
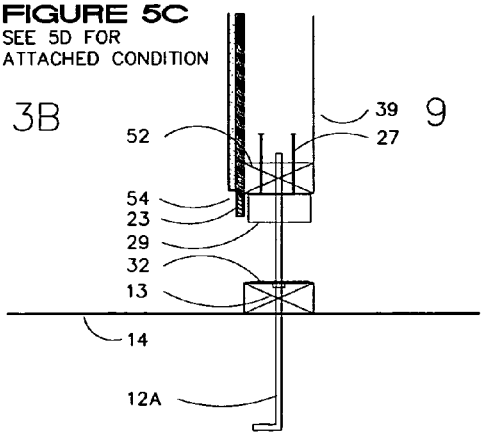
Figure 4C:
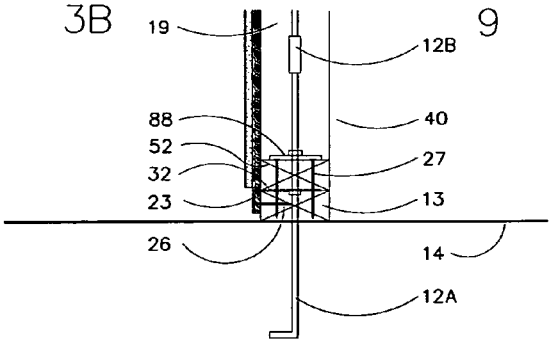

FIGS. 4B and 4C. Show an alternate enlarged section of lowest level unit (3B) separated from a concrete slab (14) and the attached wall condition to the slab. Like FIGS. 4 and 4A, except gypsum board is removed at the bottom of the wall (39) for access to install fasteners (27) through the top of the wall stud sill plate (52) into the field installed pressure treated sill plate (13). As an option, a threaded rod (12A) may hold down the end wall of the modular unit assembly. The threaded rod (12A) is spliced at each floor level with a coupling device (12B). A flat plate (88) is attached to each floor with a spring tightening nut. The threaded rod is attached to the building roof or top floor wall.

By the optional use of threated rods, that are accessible from the building interior, to resist building uplift, the modular unit exterior walls may be finished with siding in the factory. No on-site scaffolding is required for installation of weather resistive barriers, flashing and the siding material. This would save significant cost and construction time.

Figure 5C:
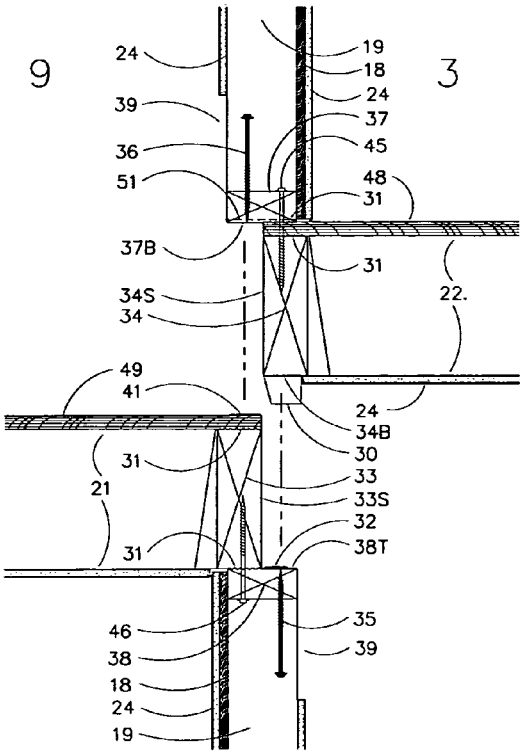
Figure 5E:
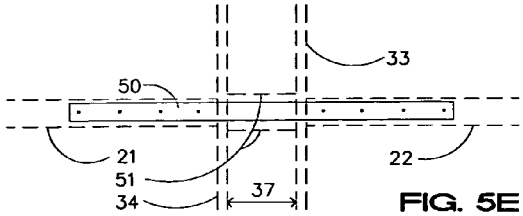
Figure 5D:
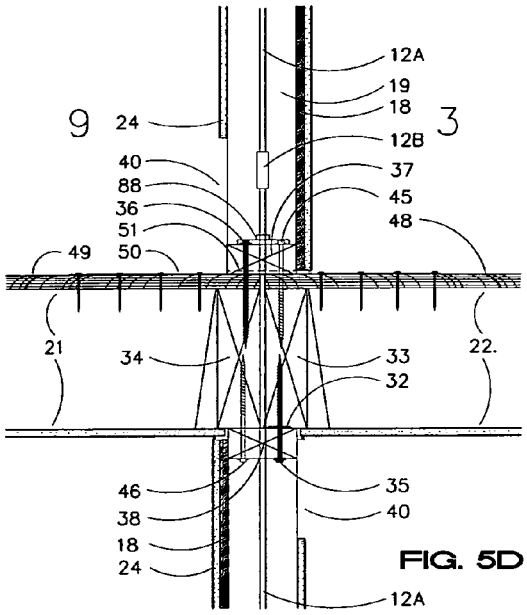

FIGS. 5C and 5D. Show an alternate enlarged section of separated and attached lower unit long wall/roof corner and upper unit long wall/floor corner. Like FIGS. 5 and 5A, except the sheet metal connector (59) is deleted. Instead, in FIG. 5C, fasteners (35) and (36) are preferably preattached to wall plates (37) and (38). FIG. 5D shows fastener (35) connecting the lower unit (3B) top plate (38) to the upper unit (3) long wall roof rim joist/beam (33). Fastener (36) attaches the upper unit (3) long wall sill plate (37) to the lower unit long wall roof rim joist/beam (34).

FIG. 5D shows another unit to unit connection option through the use of a field installed sheet metal strap (50) and fasteners through the floor sheathing (49)(48) and into the joists (21)(22) of each unit. The bottom of the sill plate (37) is kurf cut (51) about 3/32 inch to allow the strap to be pushed under the wall where the strap is needed.

FIG. 5E. Shows the plan view of optional strap (50) aligned with joists (21) and (22) and kurf cut area (51) under wall sill plate (37).

Figure 6:
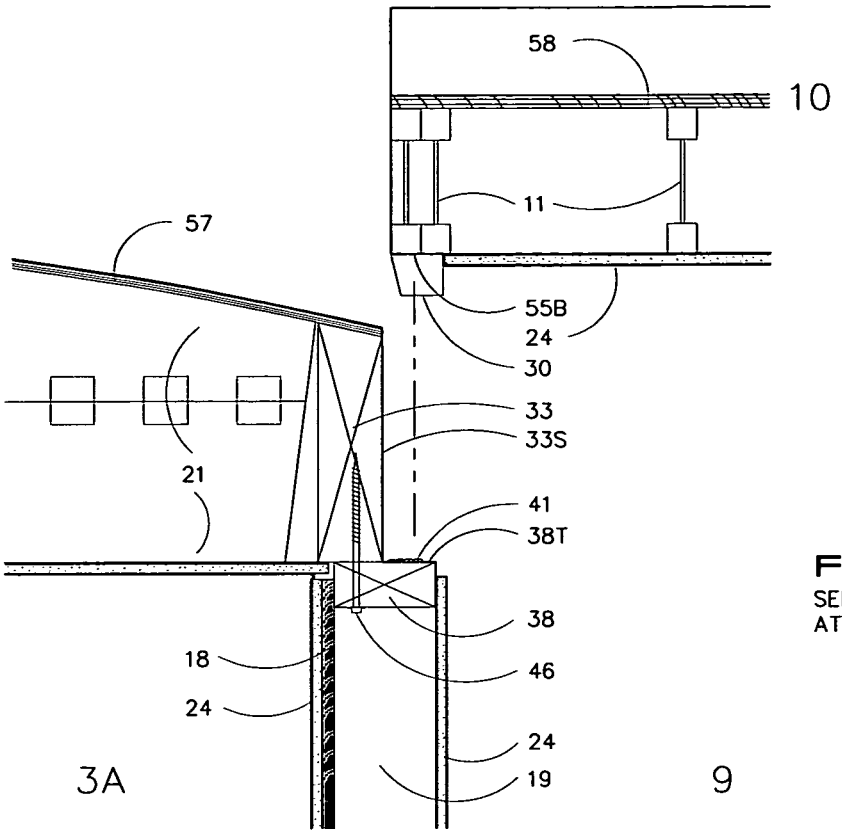
Figure 6A:
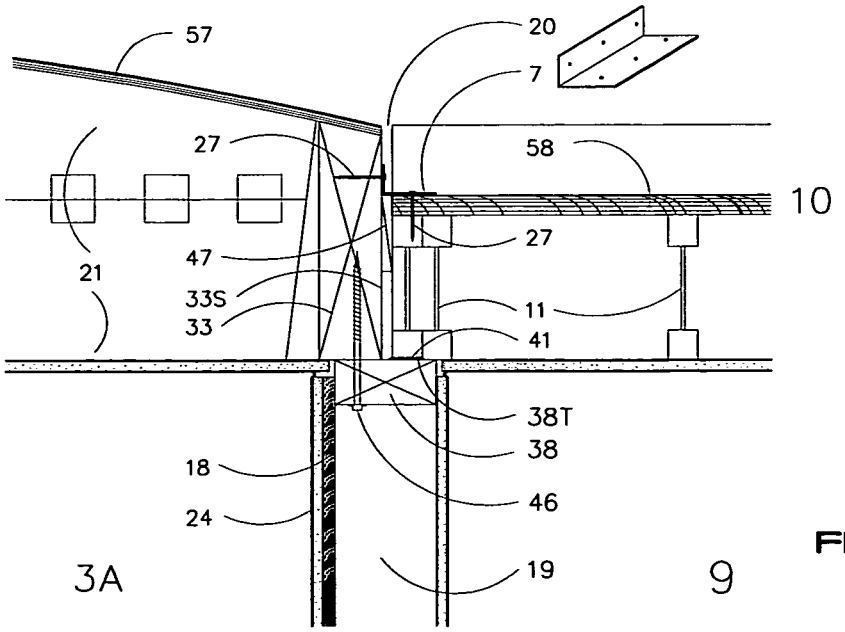

FIGS. 6 and 6A. Show enlarged sections of a separated and attached roof panel (10) to a top level modular unit (3A). The roof panel (10) is comprised of a wood deck (58) over preferably tapered joists (11). The top level unit (3A) roof is comprised of a wood roof deck (57) over joists (21) connected to a continuous rim joist/beam (33). The outside face (33S) of the rim joist/beam is recessed from the outside face of the wall studs (19) by a distance of ½ the width of the stud plus about ¼ inch. The long wall top plate (38) is fastened (46) to the rim joist/beam (33) and is optionally glued. The wall is typically one or two layers of gypsum board (24) over wood shear sheathing (18) over studs (19) preferably at 16-24 inches on center.

FIG. 6A shows the attached roof panel. Field installed sheet metal angle connectors (7) and fasteners (27) attach the roof panel sheathing (58) and rim joist to the unit's roof rim joist/beam (33). The bottom long edge of the roof panel (10) may be glued (41) and fastened to the top (38T) of the unit (3A) wall stud plate (38).

Figure 7:
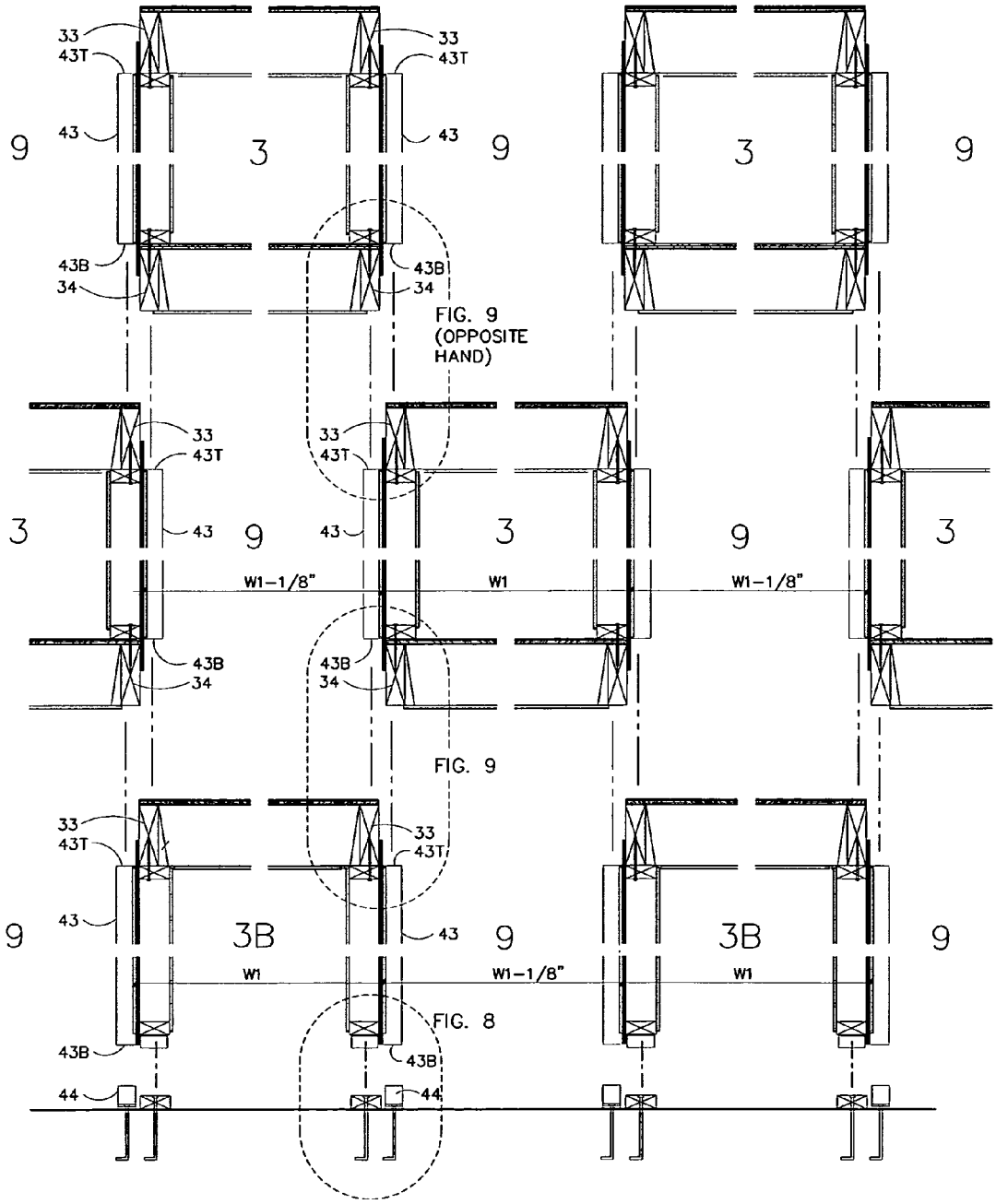

FIG. 7 Shows an alternate section of vertically separated modular units. Columns (43) are attached to the outside of the unit's long walls. Wall details are targeted for enlargement. The lowest level units are spaced from one another by a distance W1 minus about ⅛ inch, where W1 is the module width from the long wall outside face of shear sheathing to the opposite wall long wall outside face of shear sheathing.

Figure 8:
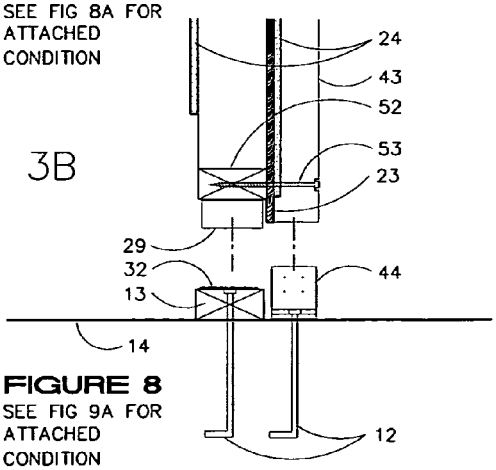
Figure 8A:
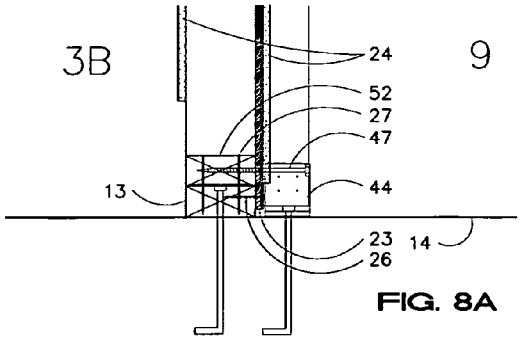

FIGS. 8 and 8A Shows an alternate enlarged section of lowest level separated and attached unit wall condition. Like FIGS. 4 and 4*a*, except a column pilaster (43) is attached (53) to the wall sill plate (52). A column base (44) is aligned with the column (43). The base of wall may be attached to the pressure treated sill plate (13) with field fasteners (27) and shear wall edge nailing (26). The column plaster (43) is fastened to column base (44).

Figure 9:
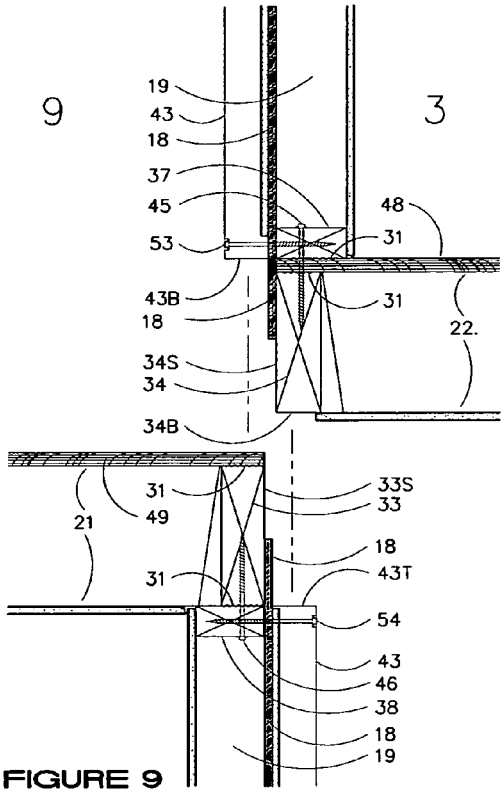
Figure 9A:
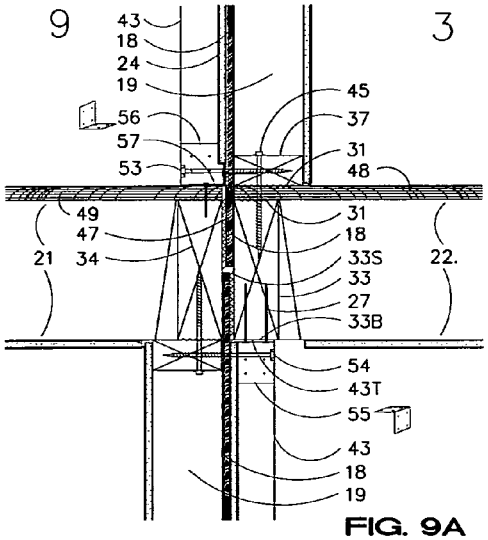

FIGS. 9 and 9A. Shows an alternate enlarged section of separated and attached lower unit long wall/roof corner and upper unit long wall/floor corner. The units are like those of FIG. 5, except the unit (3,3B) roof and floor long wall rim joist/beam's (33)(34) outside faces (33S)(34S) are aligned with the outside face of the unit wall studs (19). In addition, column pilasters (43) are attached to the top and sill plates (38)(37) of the wall. The top of the column pilaster (43T) is aligned with the bottom of the rim joist/beam (33). The bottom of the column pilaster (43B) is aligned with the top of floor sheathing. Once the upper unit is positioned, the upper unit column pilaster (43) is connected to the lower unit roof sheathing (49) and rim joist/beam (34) with sheet metal angles (56). The lower unit column pilaster (43) is connected (27) to the upper unit floor rim joist/beam (33) with sheet metal angles (55). Between column pilasters, angle sheet metal connectors (57) attach the lower unit roof sheathing (49) and rim joist/beam (34) to the upper unit wall sill plate (37) at about 8-16 inches on center.

Figure 10:
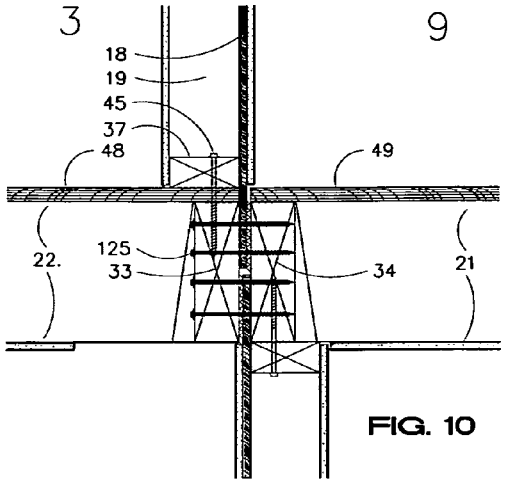

FIG. 10 Shows a modular unit alternate section of an attached lower unit long wall/roof corner and upper unit long wall/floor corner. At the top level of a building, instead of column pilasters, the floor rim joist/beam (33) may be optionally fastened (125) to the lower unit roof rim joist/beam (34).

FIG. 11 Shows an alternate unit (3) section of vertically separated Cross Laminated Timber (CLT) panels. The lowest level units are spaced apart by a distance of W2+about ¼ inch, where W2 is the width from the unit module's centerline of CLT long wall to centerline of the opposite long wall. Upper units are centered over the void space between each lower unit. The unit long wall roof/wall corner and floor/wall corner are targeted for enlargement. Finish materials are not shown for clarity.

FIG. 12 Shows an enlarged unit (3) section of wall/roof corner intersection of CLT panels. The edge face (69) of the CLT roof panel (65) is recessed from the outside face of the CLT wall (64) by a distance of ½ the width of the wall plus ⅛ inch. The roof panel (65) is connected to the wall panel (64) with spaced steel angle brackets (59) and fasteners (60)(61). The intersection of the two panels may be optionally glued. For all CLT connections, fasteners may be lag screws or machine bolts.

FIG. 13 Shows an enlarged unit (3) section of the wall/floor corner intersection of CLT panels. The edge face (70) of the CLT floor panel (66) is recessed from the outside face of the CLT wall (64) by a distance of ½ the width of the wall plus ¼ inch. The floor panel (66) is connected to the wall panel (64) with spaced steel angle brackets (58) and fasteners (62)(63).

FIG. 14 Shows an enlarged section of an attached lower unit (3) long wall/roof corner and upper unit long wall/floor corner. The upper unit wall's (64) bottom exposed edge (72) sits on the top edge (67) of the lower unit's (3) roof panel (65). The upper unit's long wall floor bottom edge (68) sits on the lower unit's exposed top of wall (71). Between the upper unit floor edge face (70) and the lower unit roof edge face (69) is a gap (77) of about ½ inch. There are two field installed steel angles. At the upper unit floor panel (66) and lower unit wall panel (64) are connected with spaced steel angle brackets (73) with fasteners (76) and (74). And the upper unit wall panel (64) is connected to the lower unit roof panel (65) with spaced steel angle brackets (73) and fasteners (75)(76). If bolt fasteners are used, the field brackets (73) are offset from the factory installed brackets (58)(59) to avoid conflict. The intersection of the two panels connected in the field may be optionally glued.

Figure 15:
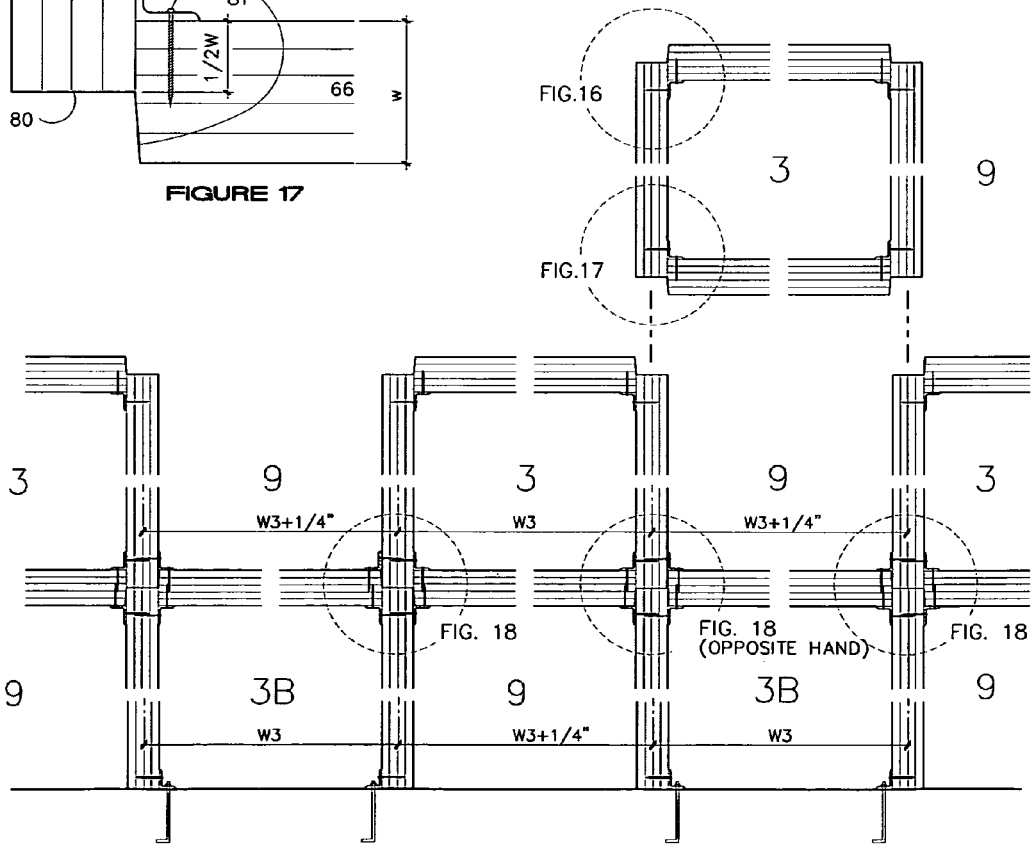

FIG. 15 Shows an alternate section of separated CLT paneled units. The design is like the FIGS. 11-14, except the unit long wall corners have a different shape. Long wall corners are targeted for enlargement. The lowest level units (3B) are spaced by a distance of W3 plus about ¼ inch, where W3 equals the width of the unit from the centerline of the unit's long wall to the centerline of the opposite wall. Upper units (3)(3A) are centered over the void space (9) between the lower units.

Figure 16:
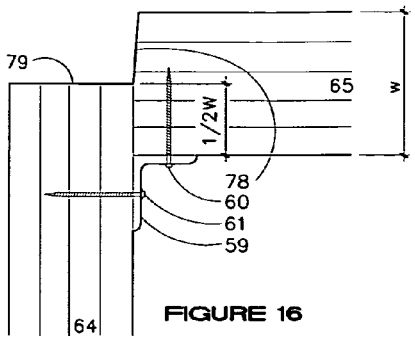

FIG. 16 Shows an alternate enlarged section of an alternate wall/roof corner of a CLT unit. The edge of the unit roof panel (65) abuts the inside face of the CLT wall panel (64). The top of the wall panel (79) is aligned with the midpoint of the roof panel (65) edge. The two panels (65)(64) are attached with spaced steel angle brackets (59) and fasteners (60) and (61). The edge of the roof panel (65) is beveled (78) about ¼ of an inch from the roof panel edge midpoint to the roof top of the panel (65).

Figure 17:
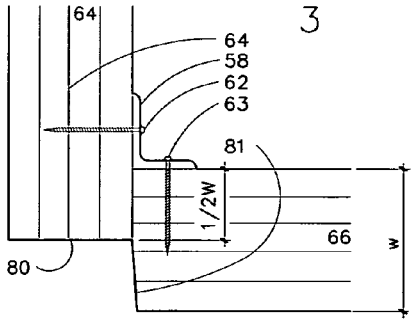

FIG. 17 Shows an alternate enlarged section of an alternate wall/floor corner of a CLT unit. The bottom of the wall panel (80) is aligned with the midpoint of the floor panel (66). The two panels (66)(64) are attached with spaced steel angle brackets (58) and fasteners (62) and (63). The edge of the floor panel is beveled (81) about a ¼ inch from the floor panel edge midpoint to the bottom face of the floor panel (66). The area of contact between the panels may be optionally glued.

Figure 18:
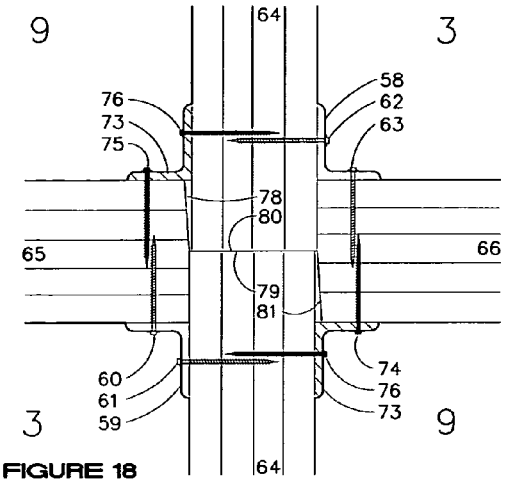

FIG. 18 Shows an enlarged section of alternate attached lower unit long wall/roof corner and upper unit wall/floor corner. The upper unit exposed long wall bottom (80) sits on the lower unit top of wall edge (79). The upper unit floor beveled edge (81) and the lower unit roof beveled edge (78), allow for easier positioning of the upper unit (3) over the lower unit (3). Two field installed steel angle brackets connect upper and lower units. Spaced steel angle brackets (73) are fastened (76) to the lower unit top of wall (64) and fastened (74) to the upper unit underside of floor (66). Steel angle brackets (73) are fastened (75)(76) to the lower unit's top of roof (65) and the upper unit's lower wall (64).

Figure 19:
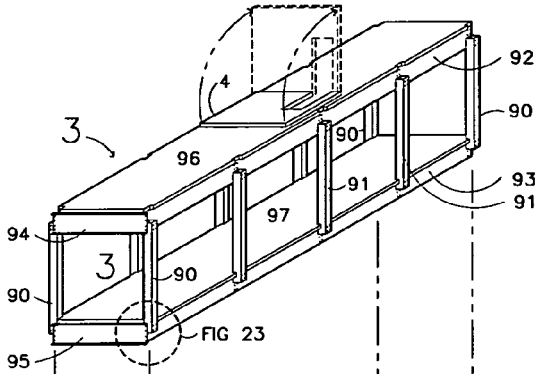

FIG. 19 Shows an isometric view of a steel framed modular unit (3) for a stagger stack assembly. With this unit (3), the weight of the building will be supported by the unit columns (90). The exterior wall column (90) connection to the floor structure (93)(97) is targeted for enlargement.

Figure 20:
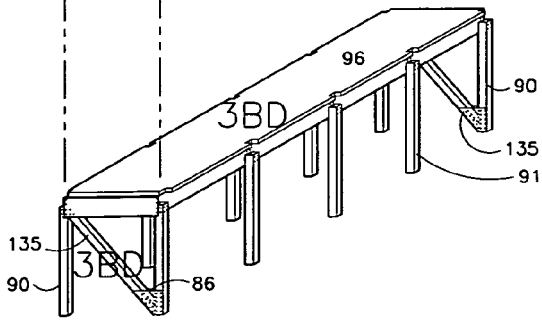

FIG. 20 Shows an isometric view of the lowest level steel framed modular unit that optionally has a diagonal brace (135) with gusset plates (86). Diagonal braces (135) may occur in the long or transverse direction of the units (3)(3B). The steel columns (90)(91) are directly connected to a structural concrete mat slab. Base isolation devices under columns may be optionally used to limit seismic forces.

Figure 21:
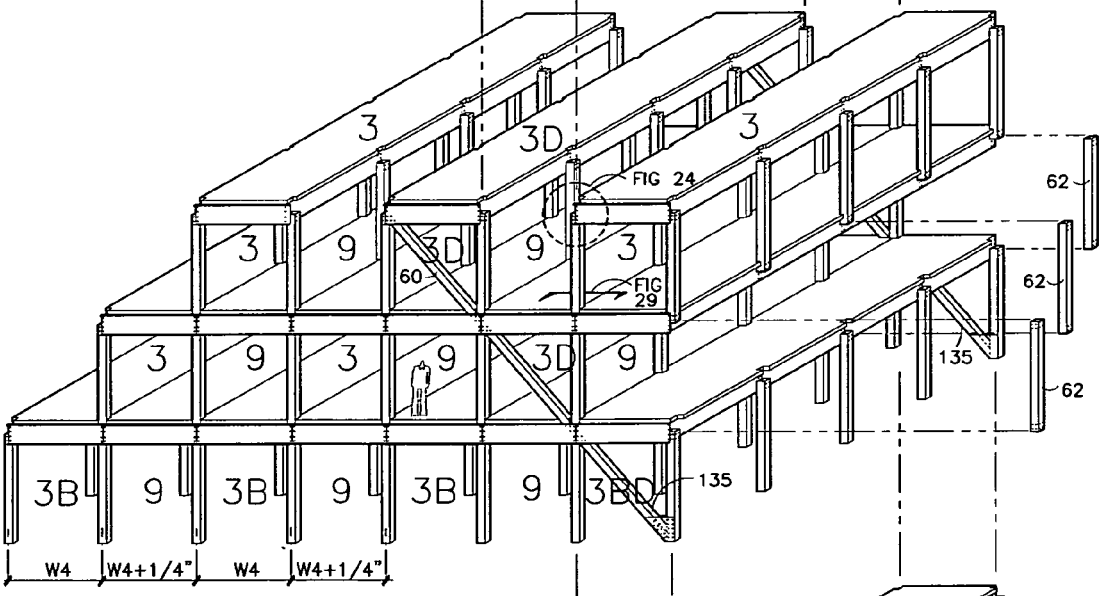

FIG. 21 Shows an isometric view of a multilevel assemblage of staggered stacked steel framed modular units (3B)(3)(3D). The lowest level units are spaced by a distance of W4 plus about ¼ inch, where W4 is equal to the width of the unit as measured from the centerline of column (90) to the centerline of the opposite long wall column (90). Optional units (3BD)(3D) with diagonal steel braces (135) and gusset plates (86) may be used. Upper units are centered over the void between lower units so that upper unit columns (90)(91) are centered over lower unit columns (90)(91). The exterior wall column (90) connection to the roof long beam and transverse beam is targeted for enlargement.

FIG. 22 Shows an isometric view of a steel framed upper unit column (90) connected to the floor long beam steel channel (93). See FIG. 26 for a detailed cross section.

FIG. 23 Shows an isometric view of a steel framed lower unit column to roof long beam steel column connected to the roof long beam steel channel (92) and exterior wall transverse beam (94). See FIG. 25 for a detailed cross section.

FIG. 24 Shows an isometric view of an alternate long beam or transverse beam. In lieu of a steel channel, a I or WF beam (126) may be used for better beam strength. The I or WF (126) flange may be cut (127) around the intersection with the unit columns (90) so the beam web can directly attach to the column (90). Castellated I beam shapes or trusses could be used for long spans, such as a 62 foot span for a parking garage.

FIGS. 25, 28 Shows a section and plan of a steel column connected to the unit roof long and transverse beam web. The top of the steel tube column (90) aligns with the midpoint, between flanges, of the unit roof long and transverse beams. The top of column (90) is factory bolted (101) to the long steel beam roof channel (92) web holes (129). The outside face of the column (90) is also bolted (100) to the transverse beam. Both the long roof beam (92) and the roof transverse beam (95) are separated from the column (90) by a shim (108) approximately ⅛ inch thick to allow easier positioning of the upper unit columns on to the lower unit columns. The shim is preferably fillet welded to the column. The long and transverse beams may also be factory fillet welded to the column. Other long roof channel web holes (106) are for field connection with an upper unit column (90). Column holes (105) are for field connection to the upper unit long floor beam. Transverse beam web holes (132) are for field connection with an upper unit column (90). Column outside face holes (130) are for field connection with the upper unit floor transverse beam. All field connection holes may be slotted for easier bolting in the field. A metal deck (96) is supported by the long floor beam (92) and optional joists (not shown).

FIGS. 26, 27 Shows a section and plan view of an upper unit steel column (90) and unit floor long (93) and transverse (94) beams. The exterior wall transverse beam steel channel (94) is factory bolted (98) to the exterior column face bolt holes. The unit floor long beam (93) is bolted (99) to the bottom side wall of the column. Both the long floor beam (93) and the floor transverse beam (94) are separated from the column (90) by a shim (108) approximately ⅛ inch thick to allow easier positioning with the lower unit column. The shim is preferably fillet welded to the column. Bolt holes for field connection with a lower unit are long beam holes (104), transverse beam holes (128) and column holes (131). All field connection holes may be slotted for easier bolting in the field. The long channel at the column is optionally chamfered (109) about ¼ inch for easier positioning with the lower unit column. The metal deck (97) is supported by the long wall beam (93) and any required joists (not shown) needed for support.

Optional interior walls with gypsum board (24) over light gage metal studs (138) are supported by light gage metal sill channel (139) with extended legs that are fastened to the metal deck (97). Cabinets, counters, sinks, toilets are wall hung. The wall extended leg sill channel is perforated with 1-1½ inch holes, so that the future concrete topping can fill the sill channel interior. An alternate is that the light weight concrete floor deck for the bathrooms and kitchen can be factory provided so that fixtures can be floor mounted.

Figure 29:
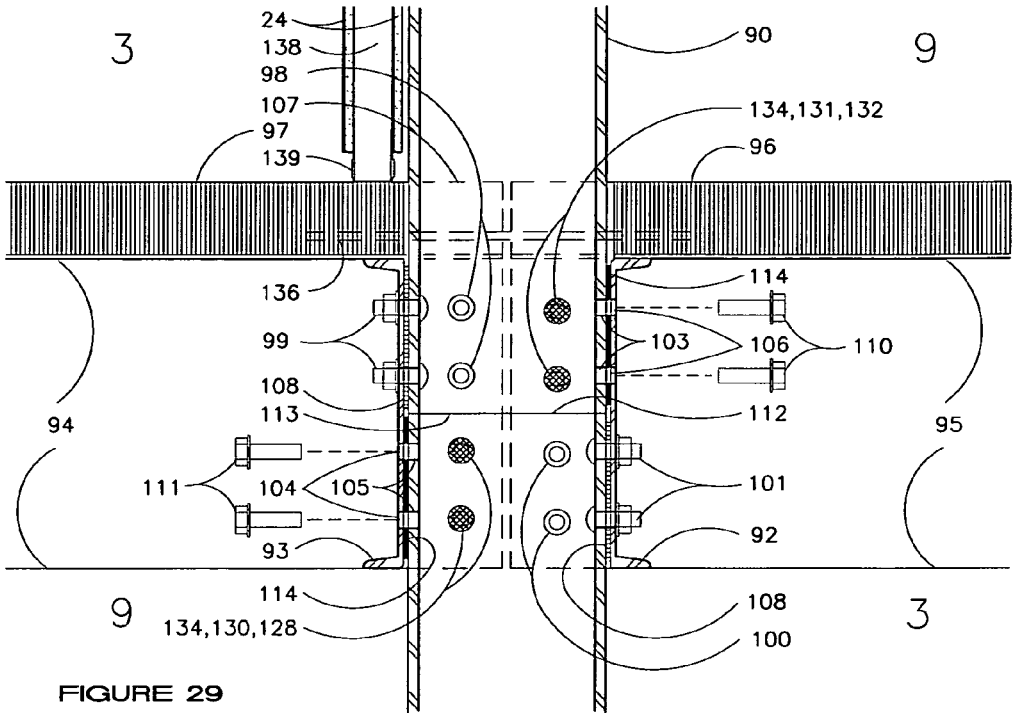

FIG. 29 Shows a section of the attached condition of a lower unit's column/roof beam(s) and upper unit's column/floor beam(s). The bottom (112) of the upper unit's column (90) fully rests on the top (113) of the lower unit's column. The two units are field bolted together. The lower unit's long beam web is field bolted with steel tube expansion bolts (110) through beam holes (106) and the upper unit's steel tube holes (103). The upper unit's long beam web is field bolted with steel tube expansion bolts (111) through the beam holes (104) and the lower unit's steel tube holes (105). The upper unit's transverse beam's web is field bolted with steel tube expansion bolts (134) through the transverse beam's web hole (128) to the lower unit's column hole (130). Also, the lower unit's transverse beam's (95) web hole (132) is field bolted with steel tube expansion bolts (134) through the upper unit's column (90) hole (131).

Optional interior walls with gypsum board (24) over light gage metal studs (138) are supported by an extended leg light gage metal sill channel (139) that rests on the metal deck (97). The extended leg sill channel (139) is perforated with approximate 1-1½ inch holes, so that the future concrete topping can fill the sill channel interior.

Figure 30:
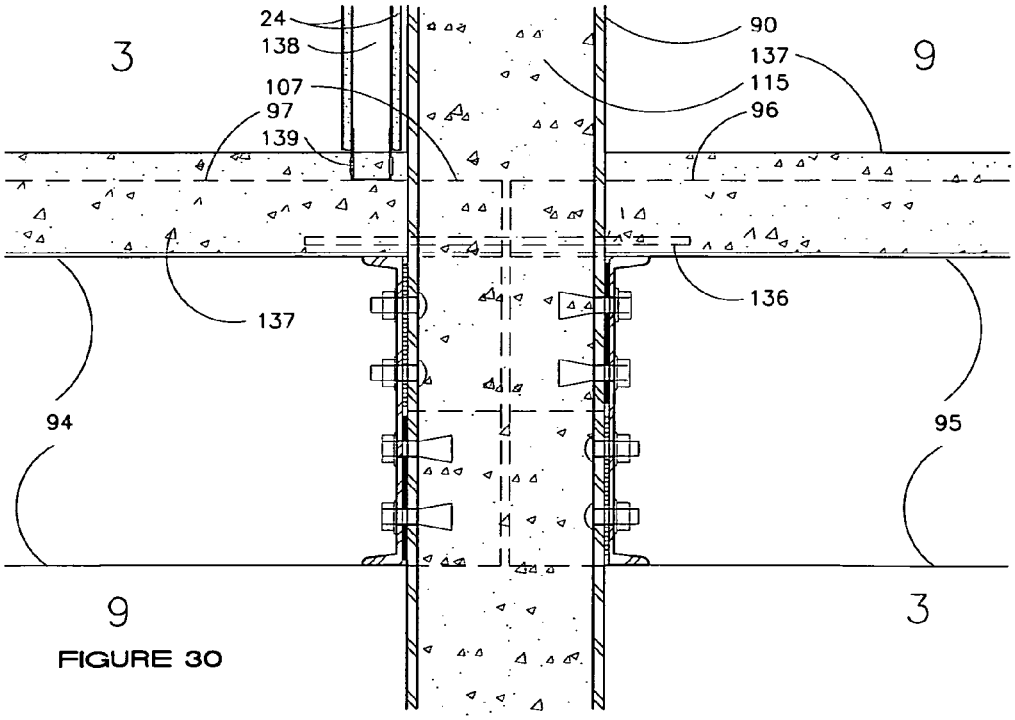
FIG. 30 Section of tube columns filled with concrete

FIG. 30 Shows a section of tube columns (90) optionally filled with concrete (115). A light weight concrete deck topping (137) is poured. Interior walls with gypsum board (24) over light gage metal studs (138) are supported by an extended leg light gage metal sill channel (139) that is fastened to the metal deck (97). Deck concrete (137) has filled the interior the perforated extended leg sill channel (139). The splice between metal decks (97)(96) is reinforced with steel rebar (136) or steel wire mesh. Since almost any size steel tube column size can be fabricated, very large steel tube columns with infill concrete and rebar can be used to support tall buildings.

I claim:

1. A building, comprising:

a rim joist having a vertical side;

a sheathing having a first vertical side, a second vertical side laterally opposite said first vertical side, a horizontal top side, and a horizontal bottom side;

a load-bearing wall, comprising a sill plate, a top plate, and a plurality of wall studs connecting said sill plate to said top plate; and a modular unit comprising:

a first of said sheathing;

a first of said rim joist attached to said bottom side of said first sheathing with said vertical side of said first rim joist aligned with said first vertical side of said first sheathing;

a second of said rim joist attached to said bottom side of said first sheathing with said vertical side of said second rim joist aligned with said second vertical side of said first sheathing;

a second of said sheathing;

a third of said rim joist attached to said bottom side of said second sheathing with said vertical side of said third rim joist aligned with said first vertical side of said second sheathing;

a fourth of said rim joist attached to said bottom side of said second sheathing with said vertical side of said fourth rim joist aligned with said second vertical side of said second sheathing;

a first of said wall attached to said first sheathing with said sill plate for said first wall extending laterally outward from said vertical side of said first rim joist and said first wall attached to said third rim joist with said top plate for said first wall extending laterally outward from said vertical side for said third rim joist; and a second of said wall attached to said first sheathing with said sill plate for said second wall extending laterally outward from said vertical side for said second rim joist and said second wall attached to said fourth rim joist with said top plate for said second wall extending laterally outward from said vertical side of said fourth rim joist.

2. The building of claim 1, wherein said modular unit comprises a first modular unit, and further comprising a second of said modular unit attached to said first modular unit with said sill plate for said second wall of said second modular unit extending over said top side of said second sheathing for said first modular unit, said top plate for said first wall for said first modular unit extending under said second rim joist for said second modular unit, said second rim joist for said second modular unit attached to said third rim joist for said first modular unit with a shim gap between said vertical face of said second rim joist for said second modular unit and said vertical face of said third rim joist for said first modular unit, and with said top side of said second sheathing for said first modular unit horizontally aligned with said top side of said first sheathing for said second modular unit.

3. The building of claim 2, further comprising a third of said modular unit attached to said second modular unit with said sill plate for said first wall of said second modular unit extending over said top side of said second sheathing for said third modular unit, said top plate for said second wall for said third modular unit extending under said first rim joist for said second modular unit, and with said top side of said second sheathing for said third modular unit horizontally aligned with said top side of said first sheathing for said second modular unit.

4. The building of claim 2, wherein said vertical face of said second rim joist for said second modular unit and said vertical face of said third rim joist for said first modular unit are laterally separated by a distance in a range from 0.25 inch to 0.75 inch.

5. The building of claim 2, wherein said second rim joist of said second modular unit is connected to said top plate of said first wall of said first modular unit.

6. The building of claim 2, further comprising a fastener connecting said second rim joist of said second modular unit to said third rim joist of said first modular unit.

7. The building of claim 2, further comprising a metal strap connecting said third rim joist on said first modular unit to said second rim joist on said second modular unit.

8. The building of claim 1, further comprising an additional plurality of said modular units, wherein any two of said modular units adjacent to one another on a same horizontal level are separated by a void and another of said a modular unit on a next higher level is centered over the void.

9. The building of claim 1, wherein said first wall is connected to said first rim joist and said second wall is connected to said second rim joist.

10. A building, comprising:

a modular unit comprising:

a floor sheathing having a floor sheathing first vertical side, a floor sheathing second vertical side laterally opposite said floor sheathing first vertical side, a floor sheathing top side disposed horizontally, and a floor sheathing bottom side parallel to said floor sheathing top side;

a first floor rim joist attached to said floor sheathing bottom side with a vertical side of said first floor rim joist aligned with said floor sheathing first vertical side;

a second floor rim joist attached to said floor sheathing bottom side with a vertical side of said second floor rim joist aligned with said floor sheathing second vertical side;

a roof sheathing having a roof sheathing first vertical side, a roof sheathing second vertical side laterally opposite said roof sheathing first vertical side, a roof sheathing top side disposed horizontally, and a roof sheathing bottom side parallel to said roof sheathing top side;

a first roof rim joist attached to said roof sheathing bottom side with a vertical side of said first roof rim joist aligned with said roof sheathing first vertical side;

a second roof rim joist attached to said roof sheathing bottom side with a vertical side of said second roof rim joist aligned with said roof sheathing second vertical side; and a first load-bearing longitudinal wall and a second load-bearing longitudinal wall, each of said first and second walls comprising:

a sill plate having a longitudinal vertical side and a bottom surface;

a top plate having a top surface;

a plurality of wall studs connecting said sill plate to said top plate; and a pilaster column connected to said sill plate and to said top plate and having a top surface aligned with said top plate top surface and a bottom surface aligned with said sill plate bottom surface, wherein:

said first wall attaches to said floor sheathing with said longitudinal vertical side of said sill plate for said first wall positioned laterally outward from said vertical side of said first floor rim joist;

said second wall attaches to said floor sheathing with said longitudinal vertical side of said sill plate for said second wall positioned laterally outward from said vertical side of said second floor rim joist;

said modular unit comprises a first modular unit; and further comprising a second of said modular unit, said second modular unit connected to said first modular unit with said pilaster column top surface on said first wall of said first modular unit connected to a bottom side of said second floor rim joist on said second modular unit and said pilaster column bottom surface on said second wall of said second modular unit connected to said roof sheathing top side of said first modular unit.

11. The building of claim 10, further comprising an additional plurality of said modular units, wherein any two of said modular units adjacent to one another on a same horizontal level are separated by a void and another of said a modular unit on a next higher level is centered over the void.

* * * * *